US005685189A

United States Patent [19]

Nguyen et al.

[11] Patent Number: 5,685,189

[45] Date of Patent: Nov. 11, 1997

[54] METHOD AND APPARATUS FOR PRODUCING CONTAINER BODY END COUNTERSINK

[75] Inventors: Tuan A. Nguyen, Golden; Todd W. Farley, Arvada, both of Colo.

[73] Assignee: Ball Corporation, Muncie, Ind.

[21] Appl. No.: 589,602

[22] Filed: Jan. 22, 1996

[51] Int. Cl.[6] ..... B21D 51/44

[52] U.S. Cl. ..... 72/348; 72/379.4; 413/8

[58] Field of Search ..... 413/8; 72/348, 72/379.4

[56] References Cited

U.S. PATENT DOCUMENTS

| | | | |
|---|---|---|---|
| 3,417,898 | 12/1968 | Bozek et al. | 220/66 |
| 3,650,387 | 3/1972 | Hornsby et al. | 206/46 F |
| 4,031,837 | 6/1977 | Jordan | 113/121 C |
| 4,109,599 | 8/1978 | Schultz | 413/8 |
| 4,434,641 | 3/1984 | Nguyen | 72/354 |
| 4,559,801 | 12/1985 | Smith et al. | 72/348 |
| 4,571,978 | 2/1986 | Taube et al. | 72/349 |
| 4,606,472 | 8/1986 | Taube et al. | 220/66 |
| 4,641,761 | 2/1987 | Smith et al. | 220/66 |
| 4,713,958 | 12/1987 | Bulso, Jr. et al. | 72/348 |
| 4,715,208 | 12/1987 | Bulso, Jr. et al. | 72/348 |
| 4,716,755 | 1/1988 | Bulso, Jr. et al. | 72/349 |
| 4,722,215 | 2/1988 | Taube et al. | 72/349 |
| 4,735,863 | 4/1988 | Bachmann et al. | 428/579 |
| 4,808,052 | 2/1989 | Bulso, Jr. et al. | 413/8 |
| 4,809,861 | 3/1989 | Wilkinson et al. | 220/66 |
| 4,865,506 | 9/1989 | Kaminski | 413/56 |
| 4,934,168 | 6/1990 | Osmanski et al. | 72/348 |
| 4,955,223 | 9/1990 | Stodd et al. | 72/336 |
| 4,991,735 | 2/1991 | Biondich | 220/600 |
| 5,046,637 | 9/1991 | Kysh | 220/610 |
| 5,149,238 | 9/1992 | McEldowney et al. | 413/8 |
| 5,356,256 | 10/1994 | Turner et al. | 413/8 |

*Primary Examiner*—Lowell A. Larson
*Attorney, Agent, or Firm*—Sheridan Ross P.C.

[57] ABSTRACT

An annular groove of a can end with a reduced radius is disclosed. In one embodiment, this is by a method and apparatus which reworks the can end to increase the strength of the can end by reducing the radius of the annular groove of the can end. This method includes the step of reworking the annular groove of the can end to reduce a magnitude of the annular groove from a first radius to a second radius by exerting an inwardly-directed force on at least part of the annular groove and relative to the annular groove and collapsing at least part of the annular groove inwardly relative to the annular groove. The apparatus used in this reworking may include inner and outer die surfaces, wherein at least one of which engages a lower portion of the annular groove, and a punch, opposing and axially movable relative to the annular groove and die surfaces, for engaging the annular groove to exert inwardly-directed forces on the lower portions of the annular groove to collapse the lower portions of the annular groove inwardly, toward the punch. The reduced radius may also be achieved in a blank and form station where an axially-directed force is exerted on a flange such that portions of the blank flex into engagement with a generally concave die surface.

61 Claims, 12 Drawing Sheets

METHOD AND APPARATUS FOR PRODUCING CONTAINER BODY END COUNTERSINK

FIELD OF THE INVENTION

The present invention generally relates to metal container body ends which are separately attached to a container body and, more particularly, to a method and apparatus for producing an annular groove for the container body end with a reduced radius (e.g., less than about 0.010 inches).

BACKGROUND OF THE INVENTION

Metal containers typically have at least one end piece which is separately attached to the container to seal the same. In a two-piece design, the container body is drawn and ironed to have an integrally formed bottom and sidewall such that only a single end is necessary to seal the container body. In a three-piece design, a sheet of metal is rolled into a cylindrical configuration and joined along a seam which extends along the entire length of the container body such that there are two open ends, each of which is sealed by separately attaching an end thereto.

Metal container designs must meet some types of strength requirements. For instance, in the case of beverage containers, which are typically of the two-piece design, often the containers are subjected to relatively high internal pressures. Moreover, the container must be able to withstand handling during-shipping when containers are often dropped. The end(s) which is separately attached to the container body is one part of the container which must meet these types of strength requirements. Balanced with the need for stronger containers, and including container ends, are economic and environmental considerations, such as reducing the amount of metal used to manufacture container ends which reduces material and transportation costs and the amount of raw materials used in can manufacture. Even a slight change in the gauge or thickness of the container or container end can result in significant economic and material usage savings due to the enormous volume of containers and container ends produced yearly. As such, there is a continued need to utilize thinner and thinner materials to form container bodies and container ends which still meet specified strength requirements.

SUMMARY OF THE INVENTION

According to one aspect of the present invention, a method for reforming a can end which is attachable to an open end of a container body (e.g., drawn and ironed) is disclosed. The "unreformed" can end comprises a central panel having a first panel diameter, an annular groove disposed about a perimeter of the central panel and being substantially defined by a first radius at a lower portion thereof, and a flange disposed about the annular groove. The lower portion of the annular groove comprises a first curved portion which is located at the bottom of the annular groove and which has an "unreformed" first radius, a chuckwall extending between the flange and the first curved portion, and an inner panel wall extending upwardly from and relative to the first curved portion. The flange is used to attach the end to the container body (e.g., by a seaming operation).

The above-described method for reforming the can end comprises the step of reworking the annular groove to reduce a magnitude of the first radius of the annular groove to a second radius. This may be accomplished by exerting an inwardly-directed force on at least part of the annular groove and relative to the annular groove, and collapsing at least part of the annular groove inwardly relative to the annular groove. For instance, an inwardly-directed force (i.e., generally toward the interior of the annular groove) may be applied on part of the first curved portion of the annular groove to push a lower part of the annular groove inwardly, generally toward the interior of the annular groove (e.g., generally toward a center of curvature of the lower portion of the annular groove). In one embodiment, such inwardly-directed forces are applied generally normal to selected parts of the first curved portion such that when the engaged portion is angularly disposed the inwardly-directed forces may also include a generally upwardly-directed component. Furthermore, the inwardly-directed force may be of a magnitude sufficient to collapse parts of the first curved portion of the annular groove being pushed inwardly, toward the interior of the annular groove. In this regard, the first radius of the annular groove may be reduced to a second radius by collapsing parts of the first curved portion of the annular groove inwardly toward the interior thereof, substantially without stretching or tensioning the annular groove, thus generally resulting in reduced thinning of the annular groove.

In one embodiment, the inwardly-directed force exerted on the lower part of the annular groove is annularly applied. For example, the inwardly-directed force may be exerted on the exterior surface of the annular groove against an inner part of the first curved portion (i.e., part of the first curved portion of the annular groove proximate the central panel) such that, relative to the central panel of the container body end, the inner part of the first curved portion is pushed radially outwardly relative to the annular groove, and generally away from the central panel. Similarly, the inwardly-directed force may be exerted on the exterior surface of the annular groove against an outer part of the first curved portion (i.e., part of the first curved portion of the annular groove proximate the flange) such that, relative to the central panel of the container body end, the outer part of the first curved portion is pushed radially inwardly relative to the annular groove, and generally toward the central panel. In another embodiment, the inwardly-directed force exerted on part of the annular groove to reduce the first radius of the first curved portion of the annular groove to a second radius comprises annularly applied symmetric forces (i.e., diametrically opposed). For instance, symmetric forces may be applied on the exterior surface of the annular groove, against opposing sides of the first curved portion of the annular groove. More specifically, inwardly-directed symmetric forces may be annularly applied on the exterior surface of the annular groove against inner and outer parts of the first curved portion of the annular groove to push the inner and outer parts of the first curved portion inwardly, toward the interior of the annular groove. Relative to the central panel of the container body end, the annularly applied symmetric forces result in radially outwardly-directed and radially inwardly-directed forces being applied against inner and outer parts of the first curved portion of the annular groove, respectively.

In another embodiment of the noted method, to exert such inwardly-directed forces on parts of the first curved portion of the annular groove to push at least a portion of the first curved portion inwardly, toward the interior thereof, the method contemplates utilizing at least one reworking tool comprising inner and outer die surfaces and a punch having a nose portion for engaging an interior surface of the annular groove about the first curved portion. In this regard, the exerting step comprises engaging portions of the annular groove, such as portions of the chuckwall, the inner panel wall and the first curved portion of the annular groove, between the punch and the inner and outer die surfaces, the punch engaging portions of the interior surface of the annular groove and the inner and outer die surfaces engaging portions of the underside of the annular groove. In this initial "engaged" configuration, the punch engages portions of the chuckwall and the inner panel wall and the nose portion engages the first curved portion. There are "unsupported" concave, relative to the punch, inner and outer segments of the annular groove of the first curved portion that are displaced from the punch. The collapsing step may thus comprise forcing these unsupported concave segments inwardly, toward the punch, substantially against corresponding portions of the punch to reduce the radius of the first curved portion of the annular groove to the second radius. In one embodiment, a single die having inner and outer die surfaces that collectively define a concave surface engages the first curved portion of the annular groove, and specifically, the unsupported concave inner and outer segments of the first curved portion. In another embodiment, separate inner and outer dies are connected to each other and collectively comprise inner and outer die surfaces, respectively, that define a concave surface, and engage the unsupported concave inner and outer segments of the annular groove. The inner and outer die surfaces may preferably engage the inner and outer segments of the first curved portion, respectively, on the exterior surface of the first curved portion, at angles generally normal to the areas of engagement between the inner and outer die surfaces and the inner and outer segments of the first curved portion, respectively.

In another embodiment of the noted method, the exerting step may comprise exerting an axial force on the container end. More specifically, an axial force may be exerted within the interior of and relative to the annular groove to apply the inwardly-directed forces on the first curved portion of the annular groove and to collapse the first curved portion of the annular groove inwardly, toward the interior thereof. For instance, exerting an axial force may be accomplished by moving the punch relative to the annular groove and the inner and outer die surfaces. Applying this axial force against the interior of the annular groove moves the annular groove toward and against the inner and outer die surfaces, causing the unsupported concave (relative to the punch) inner and outer segments of the first curved portion of the annular groove to collapse inwardly, toward the punch.

In yet another embodiment of the noted methodology, for purposes of substantially inhibiting bowing of the central panel of the container body end by "catching" or engaging a portion of the annular groove between the first curved portion and the central panel, the exerting step may further comprise exerting a radially outwardly-directed force, relative to the central panel, on the annular groove by engaging an exterior surface of an upper portion (e.g., point or band) of the annular groove, and exerting a radially inwardly-directed force, relative to the central panel, on an interior surface of an intermediate portion (e.g., point or band) of the annular groove, the intermediate portion being located between the first curved portion and the upper portion. Such radially outwardly-directed and radially inwardly-directed forces may be annularly applied on the annular groove, or alternatively, at specific locations about the circumference of the annular groove. In one embodiment, the upper and intermediate portions are located on the inner panel wall of the annular groove. The radially outwardly-directed forces may be exerted on the inner panel wall by a substantially vertical surface proximate the inner die surface. The radially inwardly-directed forces may be exerted on the inner panel wall by the punch, and specifically, by an inner curved part of the punch.

In a further embodiment of the noted method, for purposes of increasing the strength of the container end, the reworking step may further comprise increasing a magnitude of the depth of the annular groove of the can end. The reworking step may also further comprise increasing the height of the flange of the container body end.

In another aspect, the present invention is embodied in an apparatus particularly adapted to reform a container body end to reduce the radius of a first curved portion of the annular groove of the container end from a first radius to a second radius. The apparatus may comprise chamfered inner and outer die surfaces for pushing against at least a lower portion of the annular groove, and a punch, opposing and axially movable relative to the inner and outer dies and the annular groove positioned therebetween, for engaging and pushing the annular groove against the inner and outer die surfaces to reduce the first radius to a second radius. In this regard, the die surfaces exert inwardly-directed forces (i.e., toward the punch, or an interior of the annular groove) on at least parts of the first curved portion of the annular groove and relative to the annular groove as the punch is pushed against the annular groove and the inner and outer die surfaces to push portions of first curved portion of the annular groove toward the punch. In one embodiment, separate inner and outer dies may comprise chamfered inner and outer die surfaces, respectively. In an alternative embodiment, a single die comprising inner and outer chamfered surfaces which collectively define a concave surface for engaging the first curved portion of the annular groove may be utilized.

In one embodiment of the noted apparatus, where the annular groove comprises a chuckwall, an inner panel wall and a first curved portion extending therebetween and the first curved portion having an "unreformed" first radius, the punch may be moved relative to the annular groove and the inner and outer die surfaces, wherein the punch pushes part of the first curved portion of the annular groove against the inner and outer die surfaces. In this regard, the apparatus of the present invention exerts inwardly-directed forces (i.e., toward the punch) on the exterior surface of the first curved portion, and specifically, against the inner and outer sides of the first curved portion, in order to push the inner and outer sides of the first curved portion inwardly, toward the punch, to achieve a reformed second radius substantially without stretching the annular groove. In one embodiment, the inner and outer die surfaces engage the inner and outer sides of the first curved portion, respectively, at an angle generally normal thereto. The inner and outer sides of the first curved portion are pushed inwardly toward and collapsed against corresponding portions of the punch to achieve the second radius.

In yet another embodiment of the noted apparatus, in order to substantially inhibit bowing of the central panel of the can end during reworking operations and to assist in the translation of the tip (i.e., the bottom) of the annular groove downwardly, toward the vertex of the inner and outer die surfaces (i.e., toward the "intersection" of the inner and outer die surfaces), the inner die may further comprise a generally vertical working surface which extends upwardly from the inner die surface, toward the central panel of the container body end. During reworking operations, as the punch is moved to engage the annular groove and to push the first curved portion of the annular groove against the inner and outer dies, the vertical working surface "catches" (i.e., frictionally engages) and pushes against an upper portion (point or band) of the inner panel wall, to exert a radially outwardly-directed force thereon, relative to the central panel of the container body end (i.e. toward the punch). To further assist in inhibiting bowing of the central panel and translating the tip of the annular groove toward the inner and outer die surfaces, the punch may also include an inner curved part for exerting radially inwardly-directed forces (i.e., away from the punch), relative to the central panel, on the annular groove, and specifically, an intermediate portion (i.e., point or band) of the inner panel wall, which is located generally between the portions of the annular groove engaged by the inner chamfered surface and the vertical working surface. The punch and inner die may cooperate to exert such radially outwardly-directed and radially inwardly-directed forces annularly, or at specific portions along the circumference of the annular groove.

In a further embodiment of the noted apparatus, the punch may comprise a nose portion for engaging the interior surface of the annular groove, and, in particular, at least the first curved portion of the annular groove. The nose portion of the punch contacts the first curved portion of the annular groove during reworking operations and cooperates with the inner and outer die surfaces to "direct" the tip (i.e., the bottom) of the annular groove downwardly, toward the "vertex" where the inner and outer die surfaces "intersect," to achieve the second radius. The vertex, as defined by the inner and outer die surfaces, is located where the intersection of the inner and outer die surfaces would otherwise be if not for any gap therebetween. In this regard, the inner and outer die surfaces, and specifically, the gap therebetween where the vertex would otherwise be located, accommodate the downward translation of the tip of the annular groove as it provides a space into which the tip may move.

In the above-described aspects, the container end was reformed to achieve an annular groove of a reduced radius. This reformation could take place in the precurl or final curl station of a container end press in the production setting. This reformation could also take place in a totally separate press, such as a conversion press, in the production setting. Another aspect of the present invention is directed to producing a container end having an annular groove with a radius of less than about 0.010 inches directly from the stage which produces the container end itself (e.g., in the blank and form stage). A sheet of metal is initially fed into a blank and form station, a portion of the sheet is blanked to produce a blank, and the blank is formed into an end piece having a central panel, an annular groove disposed about a perimeter of the central panel and substantially defined by a radius of less than about 0.010 inches, and a flange disposed about the annular groove. In this methodology, first the flange may be formed and thereafter an axially-directed force may be exerted on the flange to flex portions of the blank against a generally concave die surface. This flexing may be enhanced by opposing the noted axially-directed force through engagement of at least a portion of the central panel.

DETAILED DESCRIPTION

Figure 1:
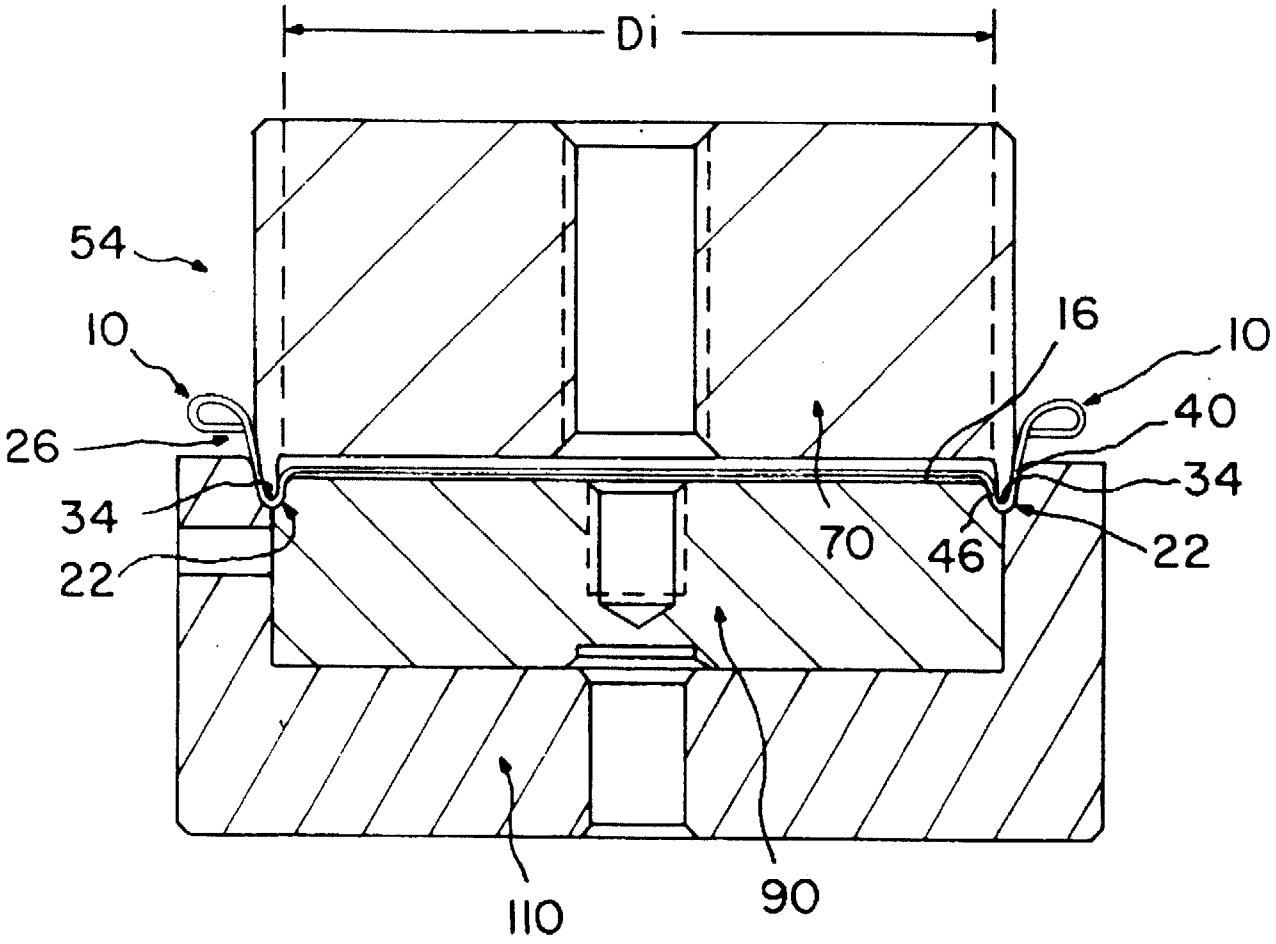
FIG. 1 is a cross-sectional view of an apparatus for reworking a can end according to principles of the present invention.

FIG. 1 illustrates a container end in accordance with principles of the present invention. Such container ends may be attached to an open end of a container body to seal the contents therein. These container ends may be used in both two-piece and three piece designs.

Figure 2A:
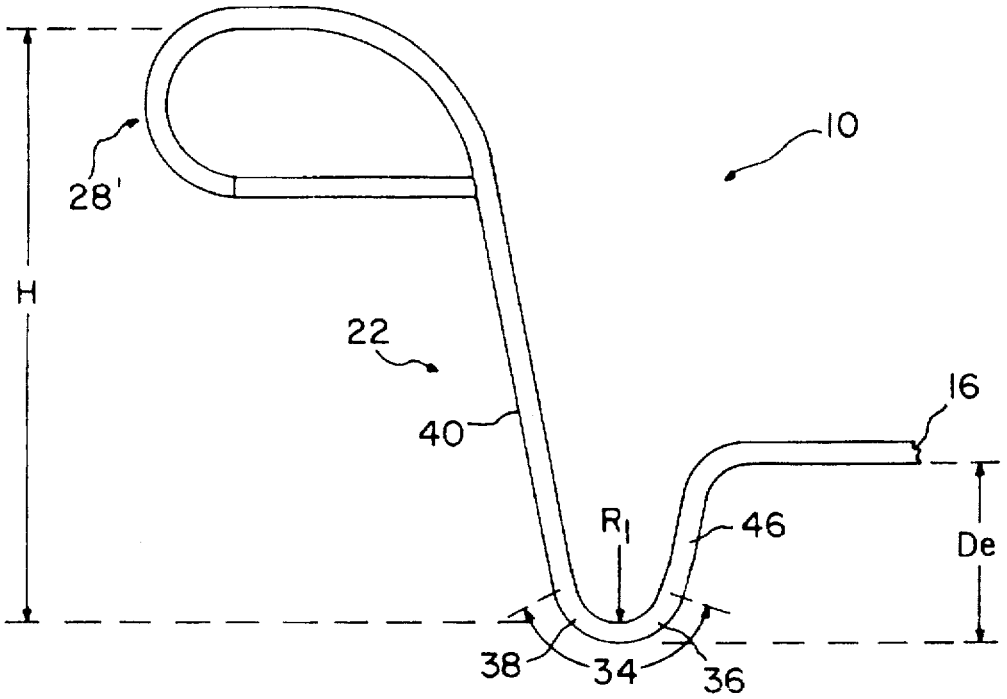
FIGS. 2A–2B shows the annular groove of the can end prior to and after reworking, respectively, according to principles of the present invention.
Figure 2B:
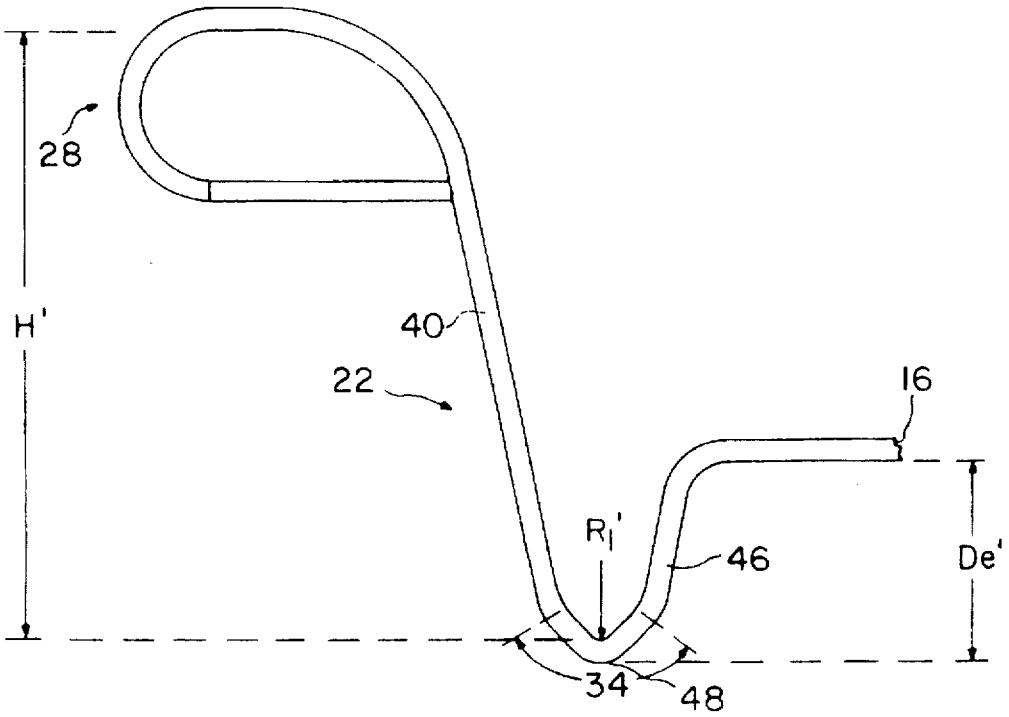

In the present invention, and as illustrated in FIGS. 1 and 2A–2B, the container end 10 generally includes a substantially planar central panel 16, an annular groove 22 disposed about a perimeter of the central panel 16, and a flange 28 disposed about the annular groove 22. The annular groove 22 includes a first curved portion 34 (i.e., countersink) at the bottom of the annular groove 22. The annular groove 22 also includes a chuckwall 40 and an inner panel wall 46, the first curved portion 34 extending between and integrally joining the chuckwall 40 and the inner panel wall 46. The chuckwall 40 extends between and integrally joins the flange 28 and the first curved portion 34 and the inner panel wall 46 extends between and integrally joins the central panel 16 and the first curved portion 34, as illustrated in FIGS. 1–2. Of importance, the first curved portion 34 of the annular groove 22 has an initial radius $R_1$. The annular groove 22 has an initial depth De and a reworked depth De'. The flange 28 has an initial height H and a reworked height H'. According to one embodiment of a method in accordance with principles of the present invention, the container end 10, and specifically the annular groove 22, may be reworked to decrease the radius $R_1$ of the first curved portion 34, for instance, to $R_1'$, such that the first curved portion 34 is generally v-shaped. Such a decrease in the radius $R_1$ of the first curved portion 34 provides increased resistance to buckling of the annular groove 22. In another embodiment of a method in accordance with principles of the present invention, the diameter Di of the central panel 16 before and after reworking remains generally constant. In this regard, the diameter Di of the central panel 16 initially and after reworking is substantially the same.

FIG. 1 and 3A–3C illustrate a reworking tool 54 which is used according to a method in accordance with principles of the present invention. The purpose of the reworking tool 54 is to reduce the radius $R_1$ of the first curved portion 34 to yield increased strength and buckle resistance of the annular groove 22. The reworking tool 54 accomplishes such a reduction in the radius of the first curved portion 34 by exerting inwardly-directed forces (i.e., toward the interior of the annular groove 22) on at least part of the annular groove 22 such that portions of the annular groove 22 are pushed inwardly, toward the interior of the annular groove (e.g., toward a center of curvature of the first curved portion 34), against corresponding segments of the reworking tool 54, as will be described in more detail below.

In the illustrated embodiment of FIGS. 1 and 2A–2B, the reworking tool 54 comprises a reform punch 70 and inner and outer dies 90, 110. The punch 70 includes a nose portion 74 for engaging an interior surface of the annular groove 22, and specifically, the first curved portion 34 of the annular groove 22, the nose portion 74 having a radius $R_2$ and comprising inner and outer working surfaces 77, 79. The inner and outer working surfaces 77, 79 of the nose portion 74 terminate into inner and outer curved parts 76, 78 having radii $R_3$ and $R_4$, which terminate into substantially inclined and vertical surfaces 80, 82, respectively. The radius of the nose portion 74 of the punch 70 substantially corresponds to the radius of a reformed/reworked annular groove 22, and specifically, a reformed, generally v-shaped first curved portion 34. In this regard, the radius $R_2$ of the nose portion 74 may be between about 0.003 inches and 0.007 inches, and preferably, less than about 0.010 inches. The radii of $R_3$, $R_4$ of the inner and outer curved parts 76, 78 of the nose portion 74 may be between about 0.028 inches and 0.032 inches each, and preferably, about 0.030 inches each. The inner and outer working surfaces 77, 79 are substantially symmetrically inclined relative to each other to achieve the reduced generally v-shaped radius $R_1$ of the first curved portion 34. In this embodiment, the inner working surface 77 is inclined at an angle of about 45° relative to the vertical surface 80 and the outer working surface 79 is also inclined at an angle of about 45° relative to the surface 80. However, it is believed that these surfaces 77 and 79 may be disposed at an angle ranging from about 30° to about 60°. For purposes of engaging the chuckwall 40 of the annular groove 22, the inclined surface 82 is substantially oriented such that the inclined surface 82 corresponds to and is substantially parallel with an upper surface of the outer die 110, which will be described below. In the illustrated embodiment, the inclined surface 82 is oriented substantially 33° relative to the outer working surface 79.

Figure 3A:
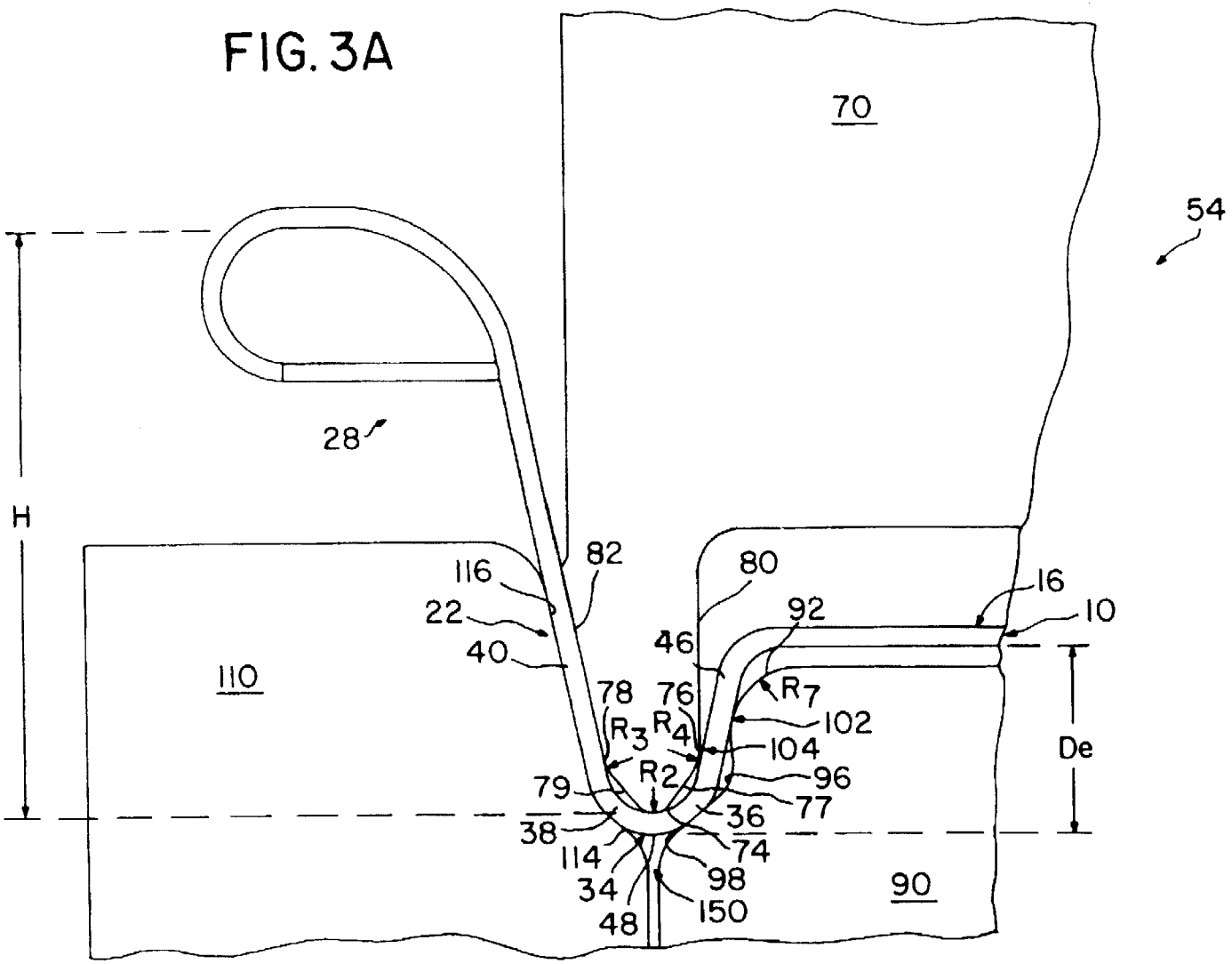
FIGS. 3A–3C are progressive, fragmentary cross-sectional views of the annular groove of the can end prior to, during, and after reworking, respectively, whereby reworking is accomplished by moving the punch axially and relative to the annular groove and the inner and outer dies.
Figure 3B:
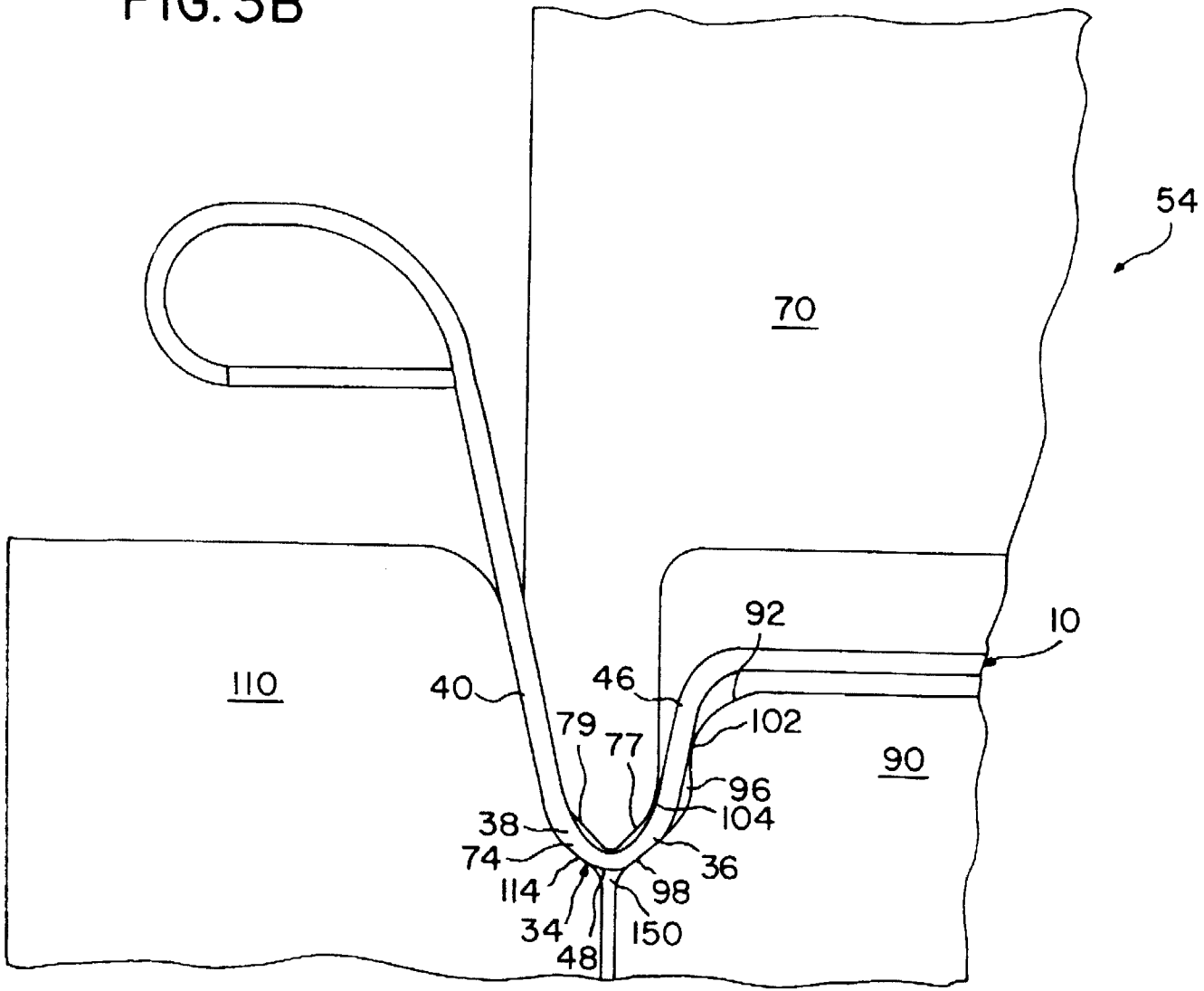
Figure 3C:
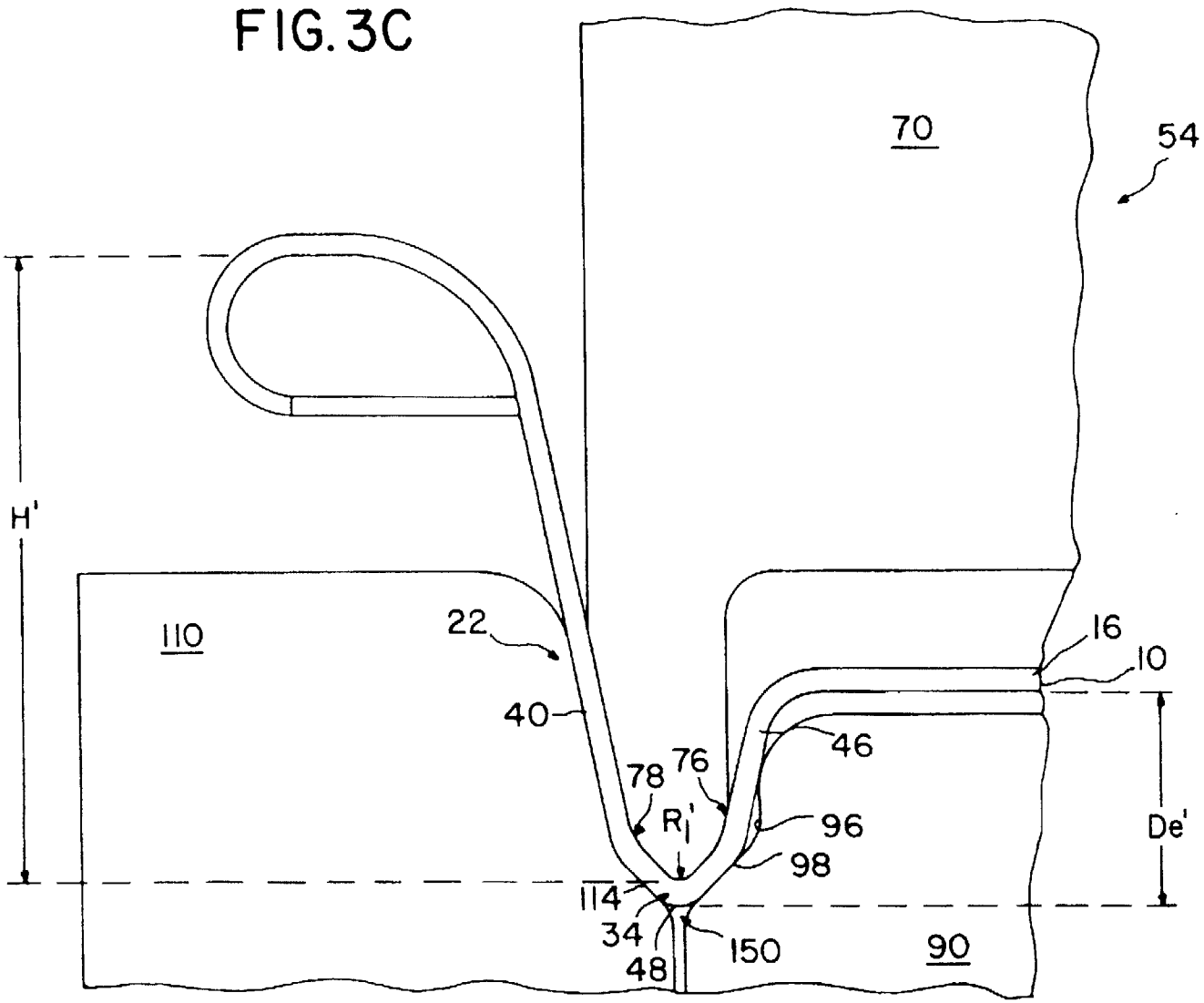

As illustrated in FIGS. 1–3, the reworking tool 54 includes a punch 70 and chamfered inner and outer die surfaces 98, 114. In the illustrated embodiment, the inner and outer die surfaces 98, 114 are part of inner and outer dies 90, 110. The inner and outer die surfaces 98, 114 cooperate with the punch 70 to reduce the radius $R_1$ of the annular groove 22 positioned therebetween to $R_1'$. As shown in FIGS. 3A–3C, the inner die 90 of the reworking tool 54 includes the annular chamfered inner die surface 98, a generally vertical working surface 96 and a convex working surface 92 having a radius $R_7$. The inner die surface 98 is engageable with and against part of the unsupported (e.g., concave shaped or having a gap between the punch and the corresponding portion of the annular groove) inner segment 36 of the first curved portion 34 and has an inclination substantially corresponding to the desired reworked radius of the first curved portion 34 and the nose portion 74 of the punch 70. In this regard, the function of the inner die surface 98 is to engage part of the inner segment 36 generally normal thereto and to push or collapse the unsupported inner segment 36 of the first curved portion 34 inwardly, toward the punch 70, such that the unsupported inner segment 36 is pressed in substantially supported or conforming engagement against the corresponding surface of the nose portion 74 of the punch 70. The inner die surface 98 is preferably inclined at a matching angle with surface 77, which as noted above is between about 30° and about 60° relative to a vertical reference axis, and more typically at an angle of between about 42° and about 48° relative to the vertical reference axis, and in the illustrated embodiment at an angle of about 45° relative to the vertical reference axis shown.

The generally vertical working surface 96 extends between and integrally joins the inner die surface 98 and the convex working surface 92. The vertical working surface 96 functions to frictionally engage or "catch" the annular groove 22, and in particular, an upper portion (e.g., point or band) 102 of the inner panel wall 46, during reworking operations with the punch 70 to substantially inhibit bowing of the central panel 16 of the container end 10 and to assist in the reduction of the radius of the annular groove 22 and the translation of the tip 48 of the annular groove 22 downwardly, toward the vertex of the inner and outer die surfaces 98, 114. In this regard, the inner die surface 98 and the vertical working surface 96, together with the punch 70, may cooperate to reduce the radius of the first curved portion 34 by exerting an inwardly-directed force (i.e., toward the punch 70) on the inner segment 36 of the annular groove 22 to collapse the inner segment 36 and exerting an inwardly-directed force (i.e., towards the punch 70) on the upper portion 102, as the inner curved part 76 of the punch 70 exerts an outwardly-directed force (i.e., away from the punch 70) on the annular groove 22 therebetween, at an intermediate portion (e.g., point or band) 104. The vertical working surface 96 and/or the inner curved part 76 may be structured to apply the radially outwardly-directed and radially inwardly-directed forces, respectively, annularly about the annular groove 22, or, alternatively, at selected portions about the circumference of the annular groove 22.

The outer die 110 illustrated in FIGS. 3A–3C, with which the punch 70 and inner die 90 cooperate to rework the annular groove 22, includes annular chamfered outer die surface 114 and inclined surface 116, which are substantially engageable against the annular groove 22, and specifically, the outer segment 38 and the chuckwall 40, respectively. It is believed that having a slidable engagement between the outer die 110 and the chuckwall 40 and the outer segment 38 substantially inhibits thinning of the chuckwall 40 during reworking operations. The outer die surface 114 is engageable with the unsupported (e.g., concave or having a gap between the punch and the corresponding portion of the annular groove) outer segment 38 of the first curved portion 34 and has an inclination substantially corresponding to the desired reworked radius of the first curved portion 34 and the nose portion 74 of the punch 70. In this regard, the function of the outer die surface 114 is to engage part of the outer segment 38 generally normal thereto and to push or collapse the unsupported outer segment 38 of the first curved portion 34 inwardly, toward the nose portion 74 of the punch 70, such that the outer segment 38 is pressed in substantially supported and conforming engagement against the corresponding surface of the nose portion 74 of the punch 70. The outer die surface 114 of the outer die 110, which is positionable proximate (i.e., with a gap therebetween or adjacent thereto) the inner die surface 98 of the inner die 90 for reworking operations, may be symmetrically inclined relative to the inner die surface 98 to form a substantially v-shaped annular groove 150. The outer die surface 114 is inclined at a matching angle with surface 79, which as noted above is between about 30° and about 60° relative to a vertical reference axis, and which is more typically at an angle of between about 42° and about 48° relative to the vertical reference axis, and in the illustrated embodiment is at an angle of about 45° relative to the vertical reference axis. The inclined surface 116 is oriented at an angle substantially corresponding to the inclined surface 82 of the punch 70 to facilitate slidable engagement with the annular groove 22, and specifically, the chuckwall 40 therebetween. In the illustrated embodiment of FIGS. 3A–3C, the inclined surface 116 is oriented at an angle of about 33° relative to the outer die surface 114.

As shown in FIGS. 3A–3C, the inner and outer die surfaces 98, 114 of the inner and outer dies 90, 114, respectively, substantially form a gapped v-shaped groove 150 which accommodates and corresponds to the reworked first curved part 34 and the nose portion 74 of the punch 70. The depth of the v-shaped groove 150 and gap between the inner and outer dies 90, 110 are sufficient to allow reformation of the first curved portion 34 of the annular groove 22 as inwardly-directed forces (i.e., toward the interior of the annular groove 22) are exerted on unsupported portions (e.g., parts of inner and outer segments) of the annular groove 22 and relative to the annular groove 22. In this regard, as the inner and outer segments 36, 38 of the first curved portion 34 are collapsed inwardly relative to the annular groove 22, the v-shaped groove 150 accommodates the resulting downward translation of the tip 48 of the annular groove 22.

Referring to FIGS. 3A–3C, in order to reduce the radius of the annular groove 22, and specifically, the first curved portion 22 (i.e., countersink) to increase the strength of the container end 10, the container end 10 is receivable between the punch 70 and the inner and outer dies 90, 110. In particular, the container end 10 may be initially positioned between the punch 70 and the inner and outer dies 90, 110 such that at least a portion of the annular groove 22 is received within at least part of the v-shaped groove 150 formed by the chamfered inner and outer die surfaces 98, 114 of the inner and outer dies 90, 110, as illustrated in FIG. 3A. In this regard, prior to reworking the annular groove 22 having a first radius, the annular groove 22 may be initially positioned between the punch 70 and the inner and outer dies 90, 110. In this initial configuration, the inclined surface 116 engages a portion of the chuckwall 40 and the outer die surface 114 engages part of the outer segment 38 of the first curved portion 34 generally normal thereto. Furthermore, the inclined surface 80 and the inner curved part 76 of the punch 70 engage the portions of the chuckwall 40 and the inner panel wall 46, respectively, and the tip 75 of the nose portion 74 of the punch 70 engages the first curved portion 34. In addition, the inner die surface 98 engages part of the inner segment 36 of the first curved portion 34 generally normal thereto and the vertical working surface 96 engages an upper portion of the inner panel wall 46. Of importance, the inner and outer segments 36, 38 of the first curved portion 34 are unsupported prior to reworking operations such that portions of the inner and outer segments 36, 38, are displaced from the inner and outer inclined working surfaces 77, 79 of the punch 70. In addition, there is a gap or space between the tip 48 of the annular groove 22 and the inner and outer dies 90, 110, as well as a gap between the vertical surfaces 99, 117 of the inner and outer dies 90, 110, respectively. In this regard, the punch 70 engages the annular groove 22 in three areas, namely, at the tip 75 of the nose portion 74 of the punch 70, at the inner curved part 76 of the punch 70 and along the inclined working surface 80, upwardly from the outer curved part 78.

As noted above, the radius of the first curved portion 34 may be reduced by exerting an inwardly-directed force (i.e., toward the punch 70) on at least part of the annular groove 22 and relative to the annular groove 22 and by collapsing at least part of the annular groove 22 inwardly, toward the punch 70, as shown in FIGS. 3A–3C. This is substantially accomplished by moving the container end 10, and, in particular, the annular groove 22 relative to the inner and outer dies 90, 110. In one embodiment, the punch 70 is moved axially relative to the annular groove 22 and the inner and outer dies 90, 110 such that an axial force is exerted on the annular groove 22 to drive the annular groove 22 against the inner and outer dies 90, 110. In this regard, and as illustrated in FIGS. 3A–3C, annular inwardly-directed forces are applied against the unsupported inner and outer segments 36, 38 of the first curved portion 34 of the annular groove 22 and relative to the annular groove 22 as an axial force is exerted thereon. In one embodiment, diametrically opposed inwardly-directed forces (i.e., toward the interior of the annular groove 22) are applied generally normal to and against the unsupported inner and outer segments 36, 38 and relative to the annular groove 22, as shown in FIG. 3A. In this regard, the forces are symmetric and diametrically opposed as the inner and outer dies 90, 110 each push "in" on the first curved portion 34 of the annular groove 22. Due to the magnitude of inwardly-directed forces exerted on the inner and outer segments 36, 38, and the unsupported nature of the inner and outer segments 36, 38, such inwardly-directed forces applied against the inner and outer segments 36, 38 collapse the inner and outer segments 36, 38 progressively inwardly relative to the annular groove 22, such that the inner and outer segments 36, 38 collapse against the punch 70, and specifically, the inner and outer inclined working surfaces 77, 79 of the punch 70, respectively, in substantial conforming engagement therewith, resulting in a reduction in radius of the first curved portion 34, as shown in FIGS. 3B–3C.

In one embodiment of a method in accordance with principles of the present invention, wherein the initial radius of the first curved portion 34 is about 0.020 inches and the wall thickness of the annular groove 22 is about 0.0086 inches, inwardly-directed linear circumferential forces having a magnitude of between about 110 lbs. and about 170 lbs. (circumferential) may be applied on and relative to each of the inner and outer segments 36, 38 to collapse the unsupported inner and outer segments 36, 38 against the inner and outer inclined working surfaces 77, 79 of the punch 70. An axial force of between about 1000 lbs. and about 1500 lbs. may be exerted on the annular groove 22 to obtain such inwardly-directed forces on the inner and outer segments 36, 38.

In order to facilitate reworking of the annular groove 22 as an inwardly-directed force (i.e., toward the punch 70) is exerted on the inner segment 36 to collapse the inner segment 36 inwardly, a method in accordance with principles of the present invention may also include exerting an inwardly-directed force (i.e., toward the punch, and generally away from the central panel) on the upper portion 102 and exerting an outwardly-directed force (i.e., away from the punch, generally toward the central panel 16) on an intermediate portion 104, above the inner segment 36. The radially outwardly-directed force may be exerted on the upper part of the annular groove 22 at the upper portion 102 by the vertical surface 96 during reworking operations to frictionally engage the inner panel wall 46. The outwardly-directed force (i.e., away from the punch 70, generally toward the central panel 16) may be exerted on the inner panel wall 46 at the intermediate portion 104 by the inner curved part 76 of the punch 70 during reworking operations. It is believed that exerting such forces on the annular groove 22 substantially inhibits bowing of the central panel 16 of the container end 10 and contributes to reformation of the annular groove 22 (i.e., reducing the radius of the annular groove 22). It is also believed that exerting such forces on the annular groove 22 substantially retains the diameter Di of the central panel 16 of the container end 10, which is indicative that there has been no substantial thinning of the end 10. It is further believed that exerting such forces on the inner panel wall 46, coupled with the slidable interface between the outer die 110, chuckwall 40 and the punch 70, contributes to "directing" the tip 48 of the first curved portion 34 downwardly as the inner and outer segments 36, 38 collapse such that a substantially v-shaped first curved portion 34 results.

The resulting reworked radius of the annular groove 22, and specifically, the reworked radius $R_1'$ of the first curved portion 34, is less than about 0.010 inches, and preferably less than about 0.007 inches, and even more preferably about 0.004 inches. The resulting reworked annular groove 22 also has an increased depth De' and flange height H', each of which further increases the strength of the annular groove 22. In this regard, the described methodology can increase the annular groove depth between about 5% and about 8%, and can increase the flange height between about 1.5% and about 3%.

Figure 4A:
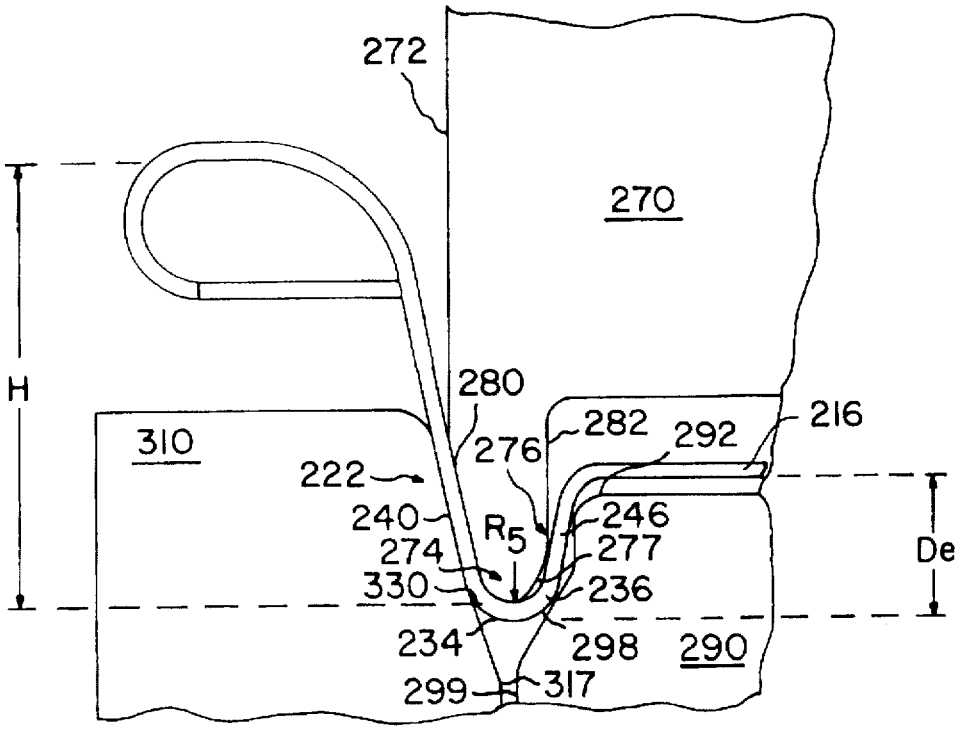
FIGS. 4A–4B show an alternative embodiment of an apparatus for reworking a can end according to principles of the present invention in fragmentary cross-sectional views of a can end prior to and after reworking, respectively.
Figure 4B:
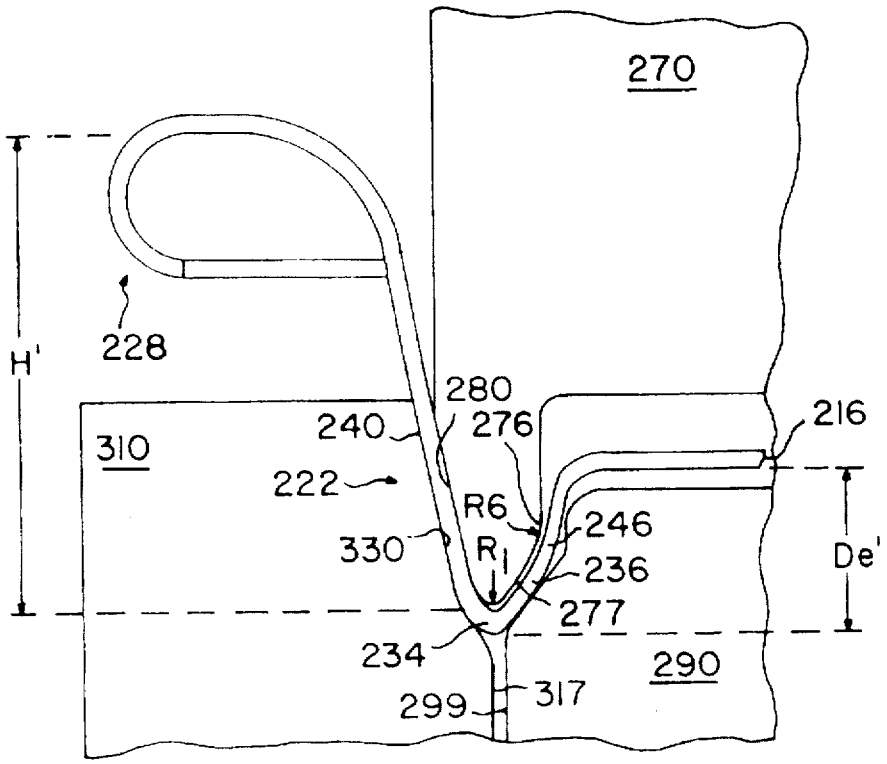

In another embodiment, shown in FIGS. 4A–4B, the punch 270 includes a nose portion 274 having a radius of $R_5$ and an inner curved part 276 for engaging the annular groove 222 proximate the inner panel wall 246, the inner curved part 276 having a radius $R_6$. The punch 270 also includes an inclined working surface 277 for engaging a portion of the annular groove 222 and a substantially linear inclined outer surface 280 for engaging the annular groove 222 proximate the chuckwall 240. Such a punch 270 is capable of reforming the annular groove 222 such that a substantially v-shaped first curved portion 234 is achieved to increase the strength thereof. In order to achieve a substantially v-shaped radius of the first curved portion 234 of the annular groove 222, the inclined working surface 277 may be angled between about 30° and about 60° relative to a vertical surface 282 of the punch 270, and in the illustrated embodiment at about 45° relative to the vertical surface 282, and the inclined outer surface 280 may be angled between about 11° and about 14° relative to a vertical surface 282 of the punch 270, and preferably, about 12.5° relative to the vertical surface 282.

The inner and outer dies 290, 310 shown in FIGS. 4A–4B are substantially similar to those shown in FIGS. 3A–3C. However, in order to cooperate with the punch 270 to yield a substantially v-shaped reworked annular groove 222 of reduced radius, the inner die surface 298 of the inner die 290 and the outer die surface 330 of the outer die 310 substantially correspond to the inclined inner working surface 277 and the inclined outer surface 280 of the punch 270. In this regard, the inner die surface 298 of the inner die 290 is preferably disposed at a matching angle with the inner working surface 277, which as noted is between about 30° and about 60° relative to a vertical surface 299 of the inner die 290, and in the illustrated embodiment is at about 45° relative to the vertical surface 299; and the outer die surface 330 of the outer die 310 is disposed at a matching angle with the outer surface 280, which as noted is between about 11° and about 14° relative to a vertical surface 317 of the outer die 310, and preferably, at about 12.5° relative to the vertical surface 317.

Referring to FIGS. 4A–4B, the annular groove 222 is positionable between the punch 270 and the inner and outer dies 290, 310. In this embodiment, the punch 270 and inner die 290 engage the inner segment 236 and inner panel wall 246 substantially as described above with respect to FIGS. 2A–2C. In this regard, an annular inwardly-directed force (i.e., toward the interior of the annular groove 222) may be applied on the unsupported inner segment 236 adjacent the first curved portion 234 and relative to the annular groove 222 to collapse the inner segment 236 against the inner inclined working surface 277 of the punch 270 to achieve a first curved portion 234 of reduced radius. According to this embodiment, the resulting reworked radius of the annular groove 222 is less than about 0.010 inches, and preferably, less than about 0.007 inches, and even more preferably, about 0.005 inches. Furthermore, the resulting reworked depth De of the annular groove 222 may increase from about 0.090 inches to about 0.095 inches, yielding an increase in the depth of the annular groove 222 of between about 4% and about 6%, and preferably, about 5%. In addition, the height H of the flange 228 may increase from about 0.270 inches to about 0.275 inches, yielding an increase in the height H of the flange 228 of between about 1.5% and about 2.0%, and preferably, about 1.8%.

The above-described embodiments pertain to reworking an annular groove of a previously formed container end. First the annular groove is formed (e.g., at a blanking and forming station), and thereafter the container end is exposed to additional processing to at least reduce the radius of the annular groove and to also potentially modify the configuration of the annular groove and/or adjacent container end structure. This reworking of the annular groove in accordance with the above may be done at a variety of locations in a production setting. For instance, reworking operations could be performed at a flange precurl or final curl station in the press used to form the container ends. These reworking operations could also be performed on a separate press than that used to produce the container ends (e.g., a conversion press). Container ends having an annular groove with a radius within the desired range of less than about 0.010 inches, and preferably from about 0.003 inches to about 0.007 inches, may also be produced directly from the container end forming process. Specifically, a container end having an annular groove within the noted range may be produced as the annular groove of the container end itself is being formed, as opposed to reforming or reworking the annular groove of an end piece. For instance, a container end with the noted desired radius may be produced in the blank and form stage of a container end press.

One embodiment of a method and apparatus for directly achieving a container end with an annular groove of a radius of less than about 0.010 inches, and preferably from about 0.003 inches to about 0.007 inches, is illustrated in FIGS. 5A–F. These figures progressively illustrate the formation of a container end having this type of radius in what is commonly characterized and a blank and form station. In the blank and form station 400, a generally circular blank or disk-like member is blanked out from a metal sheet 430 or other appropriate feed stock. This blank 434 is then drawn into a container end by the interaction of various dies discussed below. An annular groove with the above-described desired radius is achieved directly from this drawing procedure.

Figure 5A:
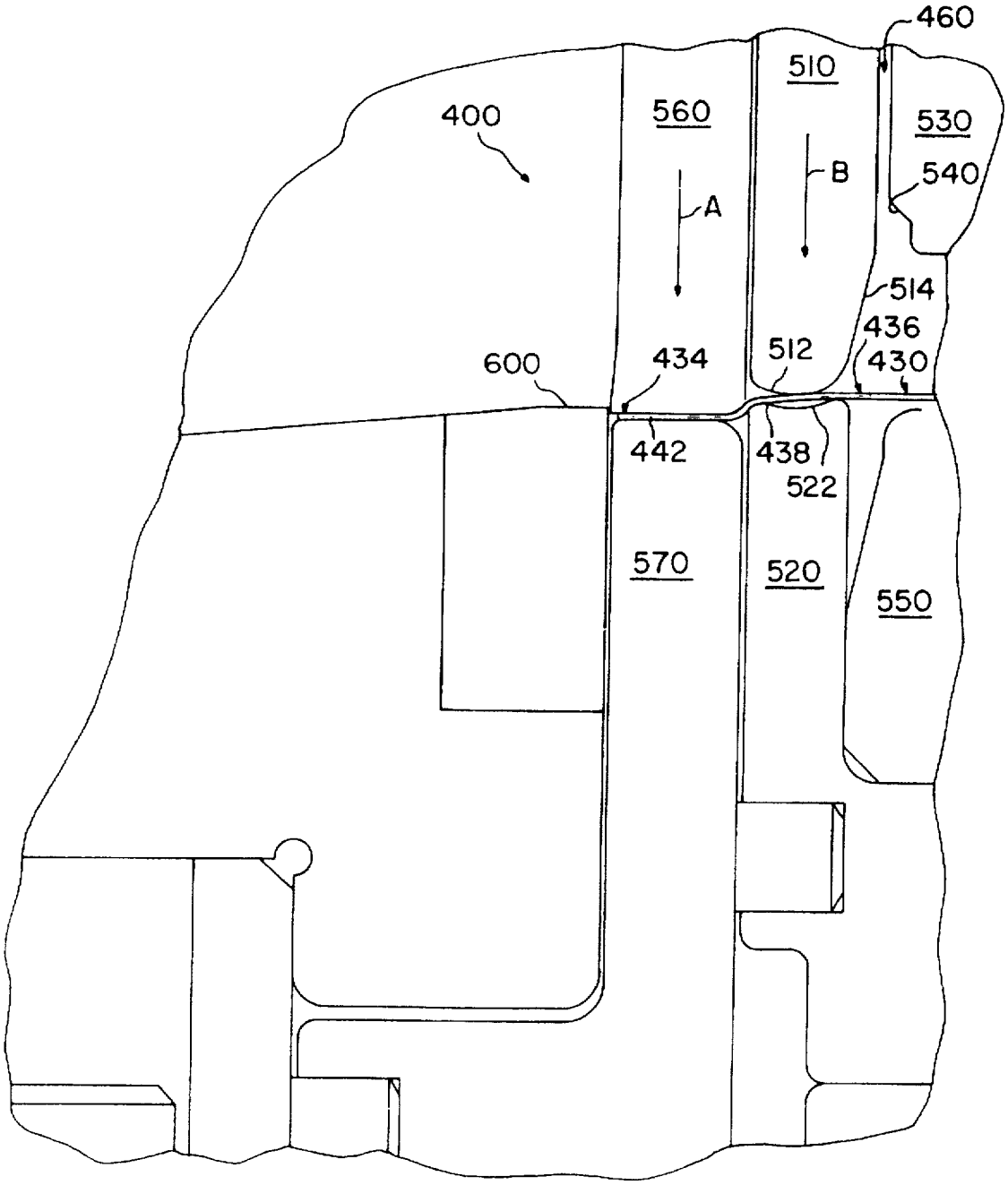
FIGS. 5A–5F show an apparatus for producing a can end according to principles of the present invention in a blank and form station in fragmentary cross-sectional views of a can end at various points in the process.

Referring to FIGS. 5A–5F, the blank and form station 400 includes first and second blanking dies 560, 570 and a support base 600 which is disposed radially outwardly of the blanking dies 560, 570. The metal sheet 430 is disposed on the support base 600 and below the first blanking die 560 and above the second blanking die 570. Subsequent axial movement of the blanking die 560 in the direction of the arrow A illustrated in FIG. 5A and relative to the stationary support base 600 produces the blank 434 from the metal sheet 430. As illustrated in FIG. 5A, the blank 434 is disposed above the second inner die 550 at this time.

The second blanking die 570 is movable in the direction of the arrow A but is biased in a direction which is generally toward the first blanking die 560 or opposite to the direction of arrow A. This may be affected by having the second blanking die 570 be spring loaded and this spring (not shown) would then be compressed during the noted movement of the first blanking die 560 such that the second blanking die 570 would also move in the direction of the arrow A during this blanking operation. Other "movably biased" mechanisms could be used, such as an air system. Although the outer perimeter 442 of the blank 434 is disposed between the first and second blanking dies 560, 570 at this time, the blank 434 is able to "slide" or move relative to the first and second blanking dies 560, 570 which facilitates the formation of the flange 412 of the can end piece 410 (e.g., the blank 434 is able to slide between the first blanking die 560 and the second blanking die 570 during formation of the flange 412).

The flange 412 is formed during a first portion of the drawing procedure in which the blank and form station 400 further utilizes first and second outer dies 510, 520 and first and second inner dies 530, 550. The first blanking die 560 continues to move in the direction of the arrow A as illustrated in FIG. 5A. The blank and form station 400 also exerts an annular, axially-directed force on an outer portion 438 of the blank 434 with the first outer die 510. In this regard, the first outer die 510 is moved axially relative to the blank 434 in the direction of the arrow B illustrated in FIG. 5A. The second outer 520 is movable in the direction of the arrow B, but is biased in a direction which is generally toward the first outer die 510 or opposite to the direction of the arrow B. This may be affected by having the second outer die 510 die be spring loaded and this spring (not shown) would then be compressed such that the second outer die 520 would also move in the direction of the arrow B illustrated in FIG. 5A. Other "movably biased" mechanisms could be used, such as an air system.

Figure 5B:
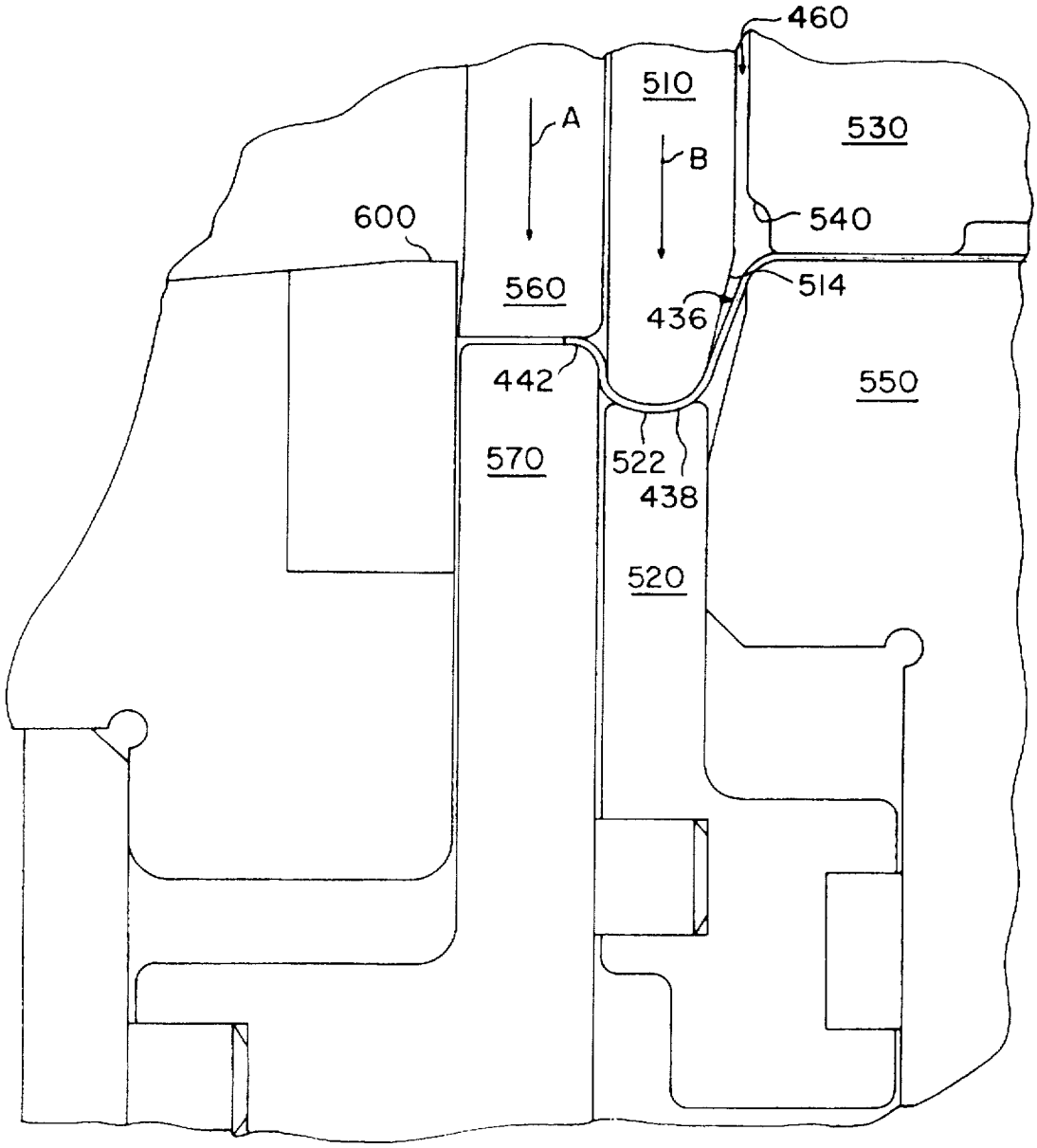

After a certain amount of movement of the first and second outer dies 510, 520 and the first and second blanking dies 560, 570 relative to the support 600, the central portion of the blank 434 engages the second inner die 550 which is illustrated in FIG. 5B. Once this engagement is established, further movement of the first and second outer dies 510, 520 in the direction of the arrow A and of the first and second blanking dies 560, 570 in the direction of the arrow B causes a certain amount of sliding-like movement of the blank 434 relative to both the blanking dies 560, 570 (e.g., by sliding between the dies 560, 570), a certain amount of sliding-like movement between the blank 434 and the outer dies 510, 520 (e.g., by sliding between the dies 510, 520), and/or a stretching of the blank 434. Achieving the noted sliding-like movement is facilitated by having the first inner die 530 compressively engage the blank 434 against the second inner die 550 which has occurred prior to the position illustrated in FIG. 5B. About the time that the blank 434 is about to become disengaged with the blanking dies 560, 570 by the sliding-like movement as illustrated in FIG. 5B, further movement of the first blanking die 560 and therefore the second blanking die 570 in the direction of the arrow B is terminated.

Figure 5C:
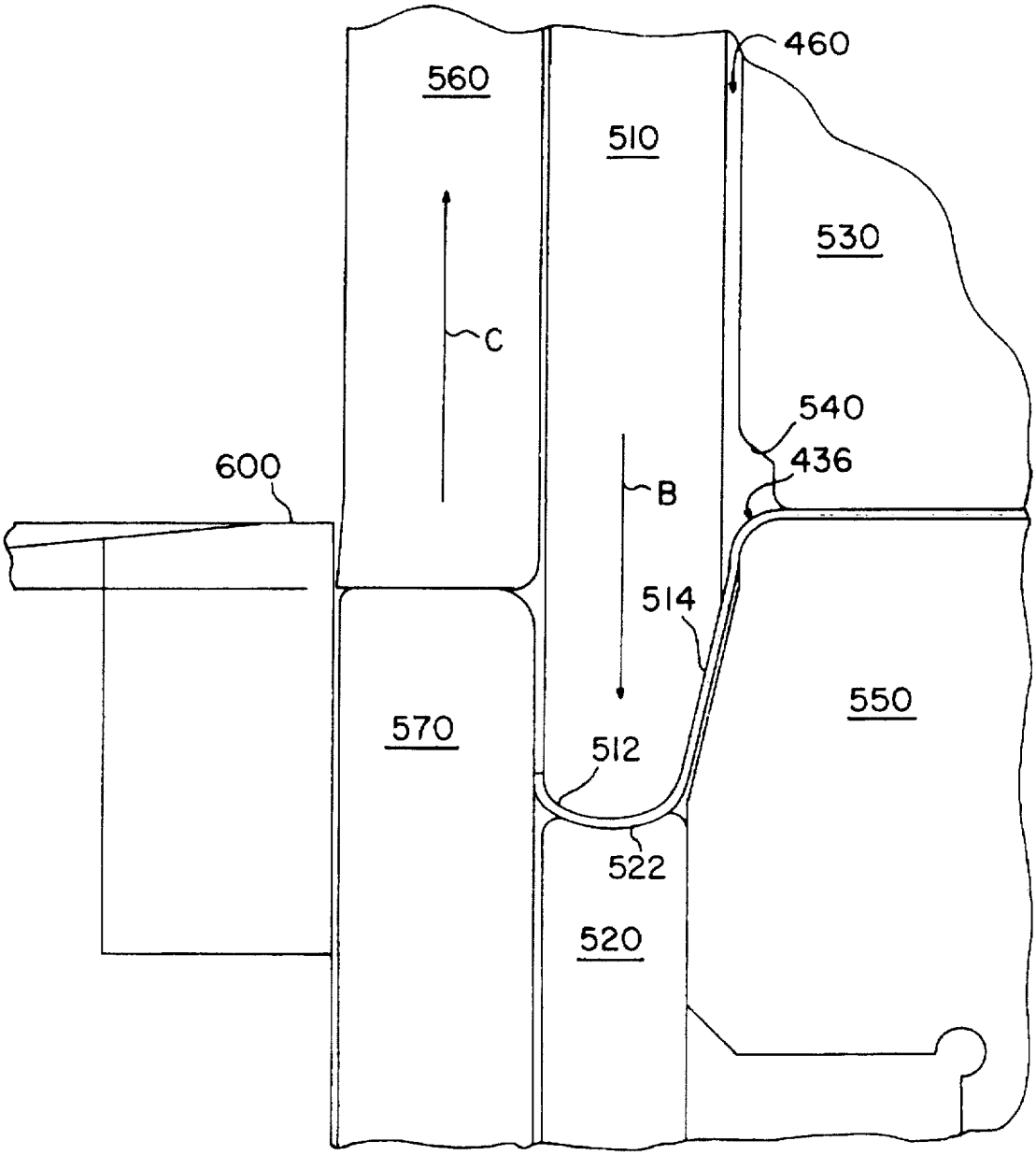

The movement of the outer dies 510 and 520 in the direction of the arrow A continues for a time after the blank 434 becomes disengaged with the blanking dies 560, 570 and results in corresponding portions of the blank 434 being forced to generally conform to the shape of the surfaces 512 and 514 of the first outer die 510 as illustrated in FIG. 5C. This is provided by sliding-like movements of portions of the blank 434 within the gap between the second blanking die 570 and the first outer die 510 and within the gap between the first outer die 510 and the second inner die 550. Once the first outer die 510 reaches its bottom dead center position which is shortly after the position illustrated in FIG. 5C, the flange 412 is completely formed. As can be seen in FIG. 5C, while the outer dies 510 and 520 continue their movement in the direction of the arrow B, some time after becoming disengaged with the blank 434 the blanking dies 560 and 570 move in the direction of the arrow C as a result of the bias of the second blanking die 570.

The annular groove 420 is formed after formation of the flange 412 utilizing, inter alia, a first die surface 540 of the first inner die 530 which engages at least a part 450 of an intermediate portion 436 of the blank 434, the second die surface 514 of the first outer die 510 which cooperates with the first die surface 540, and the second outer die 520 which conformingly engages the flange 412. The first die surface 540 and the second die surface 514 are both inclined relative to a vertical reference axis. In one embodiment, the first die surface 540 is inclined at an angle ranging from about 30° to about 60° relative to this vertical reference axis and in the illustrated embodiment is about 45° relative to vertical, while the second die surface 514 of the first outer die 510 is inclined at an angle ranging from about 10° and about 15° relative to this vertical reference axis. The vertical portion of the first inner die 530 has a length of about 0.060 inches in the illustrated embodiment, and the first surface has a length of about 0.045 inches in the illustrated embodiment.

Figure 5D:
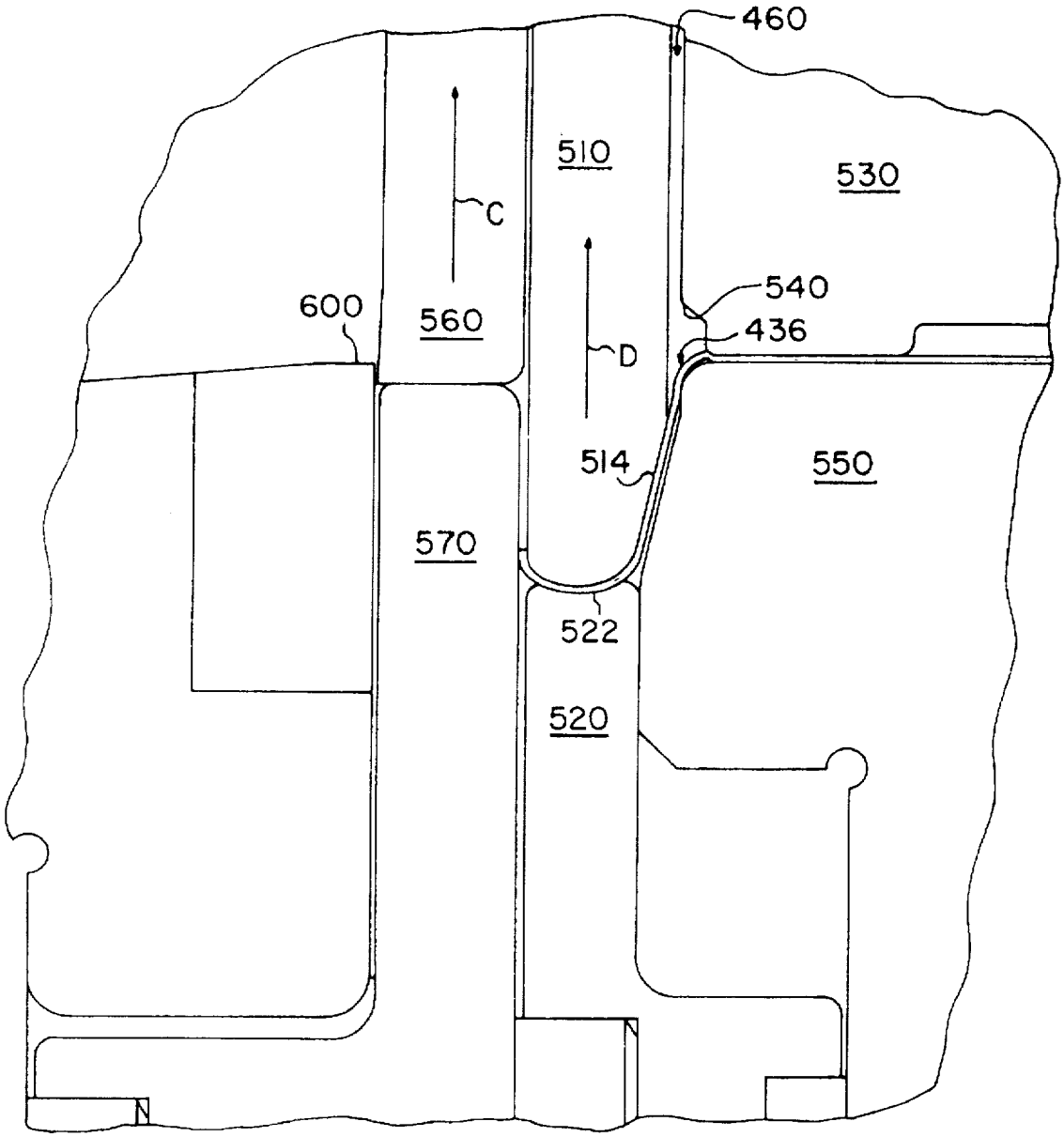

In order to form the annular groove 420 from the intermediate portion 436 of the blank 434, an annular, axially-directed force is exerted on the newly formed flange 412 to effectively flex the intermediate portion 436 into the annular groove 420. Referring to FIG. 5D, the second outer die 520, as a result of its bias, exerts an axially-directed force on flange 412 generally in the direction of the arrow D as its associated spring transmits a force on the die 520. This may be due to the driving force on the first outer die 510 being disengaged or reversed so as to axially drive the first outer die 510 in the direction of the arrow D, or alternatively to simply removing the force from the die 510 which initially drove the die 510 in the direction of the arrow B as described above. Note that the first outer die 530 remains in a substantially fixed position to forcibly retain the central portion of the drawn blank 434 against the second inner die 550. As a result of this retention of the drawn blank 434 and the force being exerted on the flange 412 by the second outer die 520 due to its expanding spring or other biasing mechanism, the intermediate portion 436 begins to flex away from the surface of the second inner die 550 as illustrated in FIG. 5D. Continued application of the noted axially-directed forces on the flange 412 by the second outer die 520, as well as the interaction of the second die surface 514 of the first outer die 510 with the blank 434, forces the intermediate portion to flex into conformance with the first die surface 540 of the first inner die 530 and for the base of the annular groove 420 to be disposed in the gap between the first inner die 530 and the first outer die 510, all as illustrated in FIG. 5E.

As illustrated in FIGS. 5A–5F, for purposes of accommodating formation of the annular groove 420 from the intermediate portion 436 of the blank 434, a gap 460 exists between the first outer and first inner dies 510, 530. In addition, formation of the annular groove 420 is accommodated by the second die surface 514 of the first outer die 510, which exerts an inwardly-directed force on and relative to the intermediate portion 436 during formation of the annular groove 420. In this regard, as the biased (e.g., spring-loaded) second outer die 520 pushes the flange 412 upwardly relative to the first and second inner dies 530, 550, the intermediate portion 436 of the blank 434 is further flexed into the gap 460 to form a generally concave groove 420.

Figure 5E:
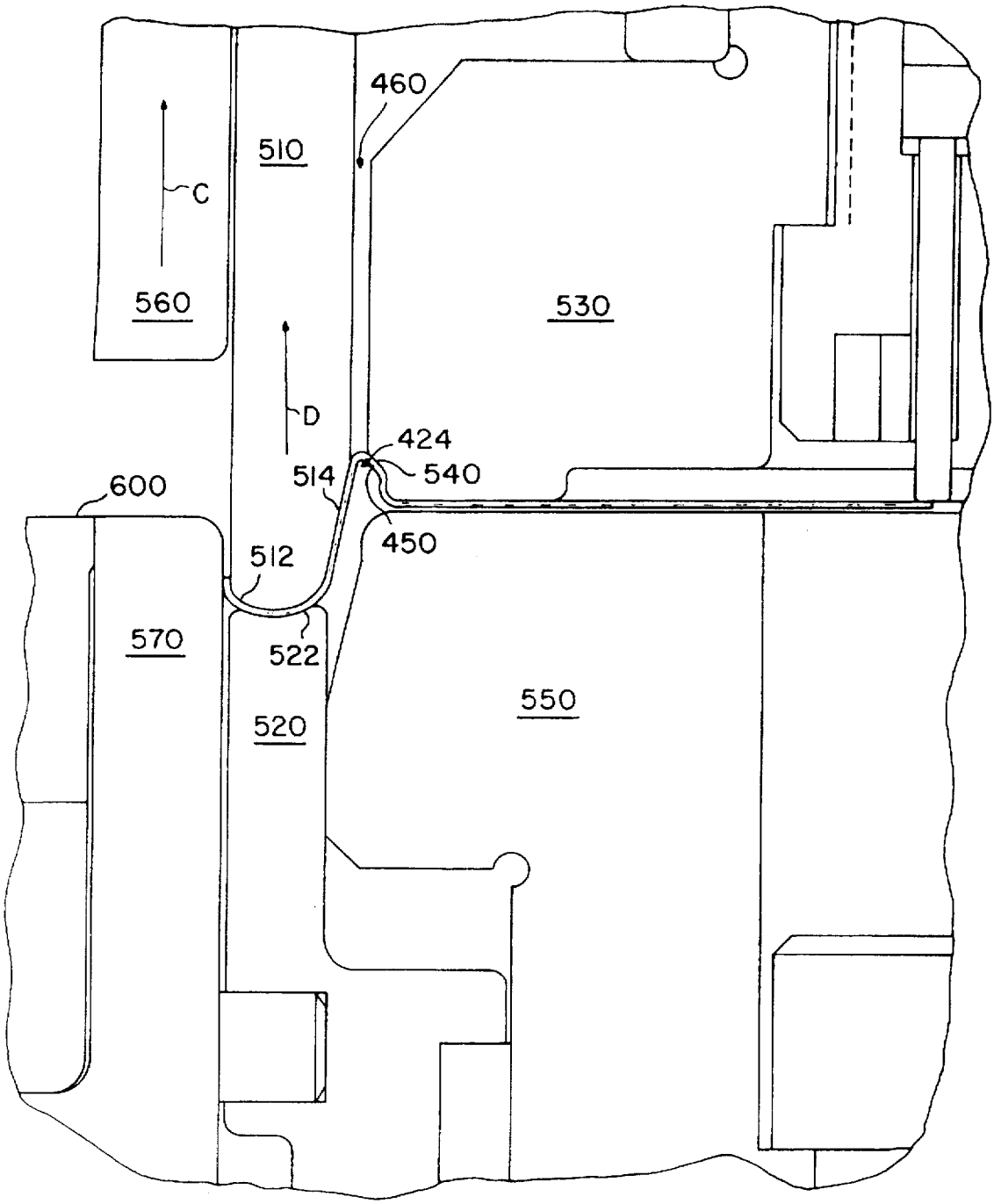
Figure 5F:
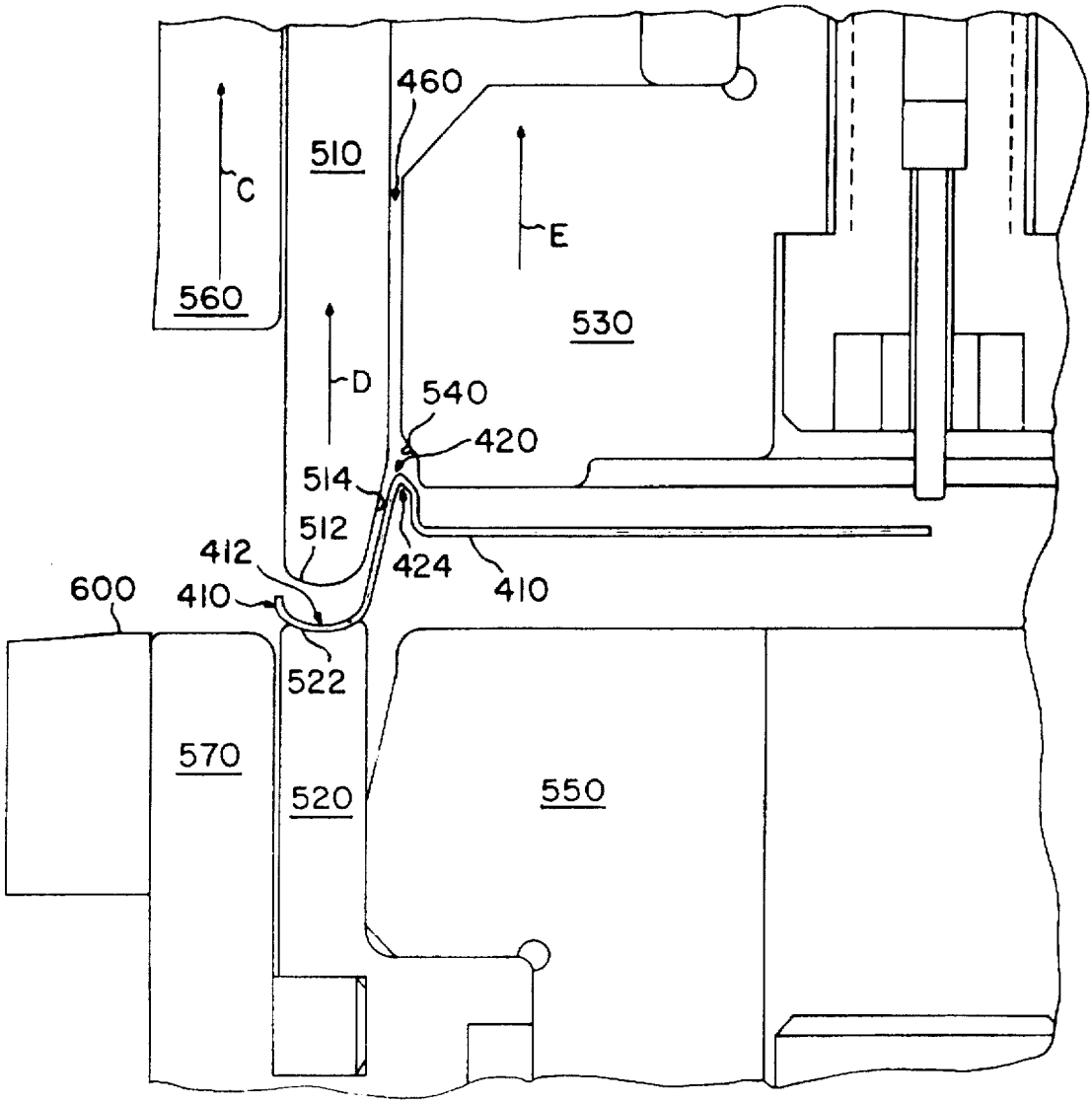

As shown in FIG. 5E, as the second outer die 520 continues to exert an axial force on the flange 412 to push the flange 412 upwardly, a part 450 of the intermediate portion 436 engages and is pushed against the first die surface 540 of the first inner die 530. In this regard, the first die surface 540 exerts an outwardly-directed force on and relative to the part 450 of the intermediate portion 436 as the flange 412 is moved upwardly relative to the first die surface 540. Thus, as the second outer die 520 continues to apply an axial force on the flange 412 to move the flange 412 upwardly relative to the first die surface 540 and the part 450, the second die surface 514 of the first outer die 510 and the first die surface 540 of the first inner die 530 cooperate to form the annular groove 420 as the upper portion 424, adjacent the part 450, is flexed therebetween, wherein the part 450 substantially conforms to the first die surface 540. In this regard, an annular groove 420 having a radius in the upper portion 424 of less than about 0.010 inches, and more preferably ranging from about 0.003 inches to about 0.007 inches, is formed in the blank and forming stage. The gap 460 is approximately 0.20 to about 0.03 inches wide at least at a point located above the first die surface 540. Once the first outer die 510 becomes disengaged from the container end 410, the first inner die 530 may be moved in the direction of the arrow E illustrated in FIG. 5F such that the end 410 may be removed from the station 400.

EXAMPLE 1

End pieces formed according to principles of the present invention were tested in order to determine whether end pieces formed according to principles of the present invention exhibited improved strength characteristics (e.g., resistance to buckling). In this regard, end pieces configured according to the present invention having a gauge of 0.0088 inches and 0.0086 inches (formed group) were tested and compared to conventional end pieces having a gauge of 0.0088 inches and 0.0086 inches (control group).

End pieces configured according to principles of the present invention exhibited improved strength characteristics. Formed group end pieces having a gauge of 0.0086 inch buckled at an average of 102.2 psi, while control group end pieces having a gauge of 0.0086 inches buckled at an average of 94.7 psi. Similarly, the formed group end pieces having a gauge of 0.0088 inches exhibited improved strength characteristics over the control group. Formed group end pieces having a gauge of 0.0088 inches buckled at an average of 106.4 psi, while control group end pieces having a gauge of 0.0088 buckled at an average of 99.2 psi.

The container ends in accordance with principles of the present invention thereby clearly exhibit increased strength. This allows for a reduction in the thickness of the sheet metal used to form the container ends which not only reduces material costs, but also preserves our natural resources. Although reducing the gauge of the sheet metal typically dictates a loss of strength, by utilizing principles of the present invention at least some of this strength is recovered such that the container ends will still meet the various container body strength specifications.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described hereinabove are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A method for reforming an end piece which is attachable to an open end of a container body, said end piece comprising a central panel having a first panel diameter, an annular groove disposed about a perimeter of said central panel, and a flange disposed about said annular groove, wherein said annular groove comprises a first curved portion defining a bottom of said annular groove and being substantially defined by a first radius, and wherein said end piece comprises first and second surfaces, said method comprising the step of:

reworking said annular groove to reduce a magnitude of said first radius to a second radius, comprising the steps of engaging said annular groove on said second surface at first and second spaced locations, said first location being on said first curved portion and said second location being vertically displaced from said first location, wherein said annular groove is unsupported on said second surface between said first and second locations, exerting an inwardly-directed force on at least part of said annular groove on said first surface and relative to said annular groove during at least the time said annular groove is unsupported on said second surface between said first and second locations, and collapsing said at least part of said annular groove inwardly relative to said annular groove.

2. A method, as claimed in claim 1, wherein said exerting step comprises applying an annular inwardly-directed force on said at least part of said annular groove and relative to said annular groove.

3. A method, as claimed in claim 1, wherein said exerting step comprises applying diametrically opposed inwardly-directed forces on said first surface on opposing portions of said annular groove and relative to said annular groove.

4. A method, as claimed in claim 1, wherein said exerting step comprises applying annular diametrically opposed inwardly-directed forces on said first surface on opposing portions of said annular groove and relative to said annular groove.

5. A method, as claimed in claim 1, wherein said exerting step comprises exerting an axial force on said end piece.

6. A method, as claimed in claim 1, wherein said first curved portion extends between and integrally joins a chuckwall and an inner panel wall of said annular groove, wherein at least one reworking tool comprising a punch and inner and outer die surfaces is used for said exerting step, said punch interfacing with said second surface and said inner and outer dies interfacing with said first surface.

7. A method, as claimed in claim 6, wherein said exerting step comprises engaging portions of said chuckwall, said first curved portion and said inner panel wall between said punch and said inner and outer die surfaces.

8. A method, as claimed in claim 7, wherein said chuckwall slidably engages said outer die surface.

9. A method, as claimed in claim 7, wherein said exerting step further comprises moving said punch relative to said annular groove and said inner and outer die surfaces to push at least part of said first curved portion inwardly, toward said punch, wherein a portion of said second surface defined by said at least part of said first curved portion is generally concave.

10. A method, as claimed in claim 9, wherein said collapsing step comprises forcing said at least part of said first curved portion against and in generally conforming relation with a corresponding portion of said punch.

11. A method, as claimed in claim 9, wherein said at least part of said first curved portion comprises a first part which interconnects with said inner panel wall and a second part which interconnects with said chuckwall, wherein said inner and outer die surfaces engage at least part of said first and second parts of said first curved portion, respectively, at an angle generally normal thereto.

12. A method, as claimed in claim 9, wherein said exerting step further comprises exerting an inwardly-directed force toward said punch on an upper part of said annular groove by engaging an upper portion on said annular groove, and exerting an outwardly-directed force away from said punch on a lower part of said annular groove by engaging an intermediate portion of said annular groove, wherein said upper and intermediate portions are located on said inner panel wall.

13. A method, as claimed in claim 12, wherein said reworking tool further comprises a vertical working surface adjacent said inner die surface, wherein said exerting an inwardly-directed force toward said punch step comprises engaging said vertical working surface against said upper portion of said inner panel wall.

14. A method, as claimed in claim 12, wherein said punch comprises a nose portion for engaging said first curved portion and an inner curved part displaced above said nose portion, wherein said exerting an outwardly-directed force away from said punch step comprises engaging said inner curved part of said punch against said intermediate portion of said inner panel wall.

15. A method, as claimed in claim 6, further comprising the step of exerting an inwardly-directed force toward said punch on one of said chuckwall and said inner panel wall to form a second curved portion, separate from said first curved portion, on said annular groove.

16. A method, as claimed in claim 15, wherein said second curved portion is formed on said chuckwall and has a radius of between about 0.025 inches and about 0.035 inches.

17. A method, as claimed in claim 15, wherein said second curved portion is formed on said inner panel wall and has a radius of between about 0.025 inches and about 0.035 inches.

18. A method, as claimed in claim 1, wherein said second radius less than about 0.010 inches.

19. A method, as claimed in claim 1, wherein said second radius is about 0.005 inches.

20. A method, as claimed in claim 1, wherein said annular groove is further substantially defined by a first depth, wherein said reworking step further comprises the step of increasing a magnitude of said first depth to a second depth.

21. A method, as claimed in claim 20, wherein the depth of said annular groove increases at least about 1.5%.

22. A method, as claimed in claim 1, wherein said flange is defined by a first height, wherein said reworking step further comprises the step of increasing a magnitude of said first height to a second height.

23. A method, as claimed in claim 1, further comprising the step of:

substantially maintaining said first panel diameter of said center panel after said reworking step.

24. A method, as claimed in claim 1, wherein a first apex on said first surface of said first curved portion exists prior to said reworking step, wherein said collapsing step directs said first apex further away from said central panel.

25. A method as claimed in claim 1, wherein said exerting step is provided on said first surface between said first and second locations.

26. An apparatus for reforming a container end having a central panel, an annular groove disposed about a perimeter of said central panel and having a lower portion substantially defined by a first radius and a flange disposed about said annular groove, said apparatus comprising:

inner and outer die surfaces for engaging at least said lower portion of said annular groove; and a punch, opposing and axially movable relative to said inner and outer die surfaces and said annular groove positioned therebetween, for engaging said lower portion of said annular groove against said inner and outer die surfaces to reduce said first radius to a second radius, wherein said inner and outer die surfaces exert inwardly-directed forces toward said punch on said lower portion of said annular groove and relative to said annular groove as said punch is moved relative to said annular groove and said inner and outer die surfaces to collapse said lower portion of said annular groove toward corresponding portions of said punch.

27. An apparatus, as claimed in claim 26, wherein said annular groove comprises a chuckwall, an inner panel wall and a first curved portion extending therebetween, wherein said annular groove comprises concave inner and outer segments adjacent said first curved portion.

28. An apparatus, as claimed in claim 27, wherein said punch is configured such that portions of said inner and outer segments are unsupported relative to and displaced from said punch.

29. An apparatus, as claimed in claim 27, wherein said inner and outer die surfaces are configured to engage portions of said inner and outer segments, respectively.

30. An apparatus, as claimed in claim 27, wherein said inner and outer die surfaces are configured to engage against portions of said inner and outer segments, respectively, to exert diametrically opposed inwardly directed forces on said inner and outer segments to push said inner and outer segments inwardly, toward said punch.

31. An apparatus, as claimed in claim 26, wherein said inner die surface is angled between about 30° and about 60° relative to a vertical reference axis.

32. An apparatus, as claimed in claim 26, wherein said inner and outer die surfaces are each angled between about 30° and 60° and between about 30° and 60°, respectively, relative to a vertical reference axis.

33. An apparatus, as claimed in claim 26, further comprising a vertical working surface, wherein said vertical working surface is engageable on an upper portion of said annular groove to exert an inwardly-directed force, toward said punch, thereon.

34. An apparatus, as claimed in claim 33, wherein said vertical working surface is adjacent to and extends above said inner die surface.

35. An apparatus, as claimed in claim 26, further comprising an inclined surface adjacent and extending above said outer die surface, wherein said inclined surface is slidably engageable with said annular groove.

36. An apparatus, as claimed in claim 26, wherein said punch comprises a nose portion for engaging at least said first curved portion to push said annular groove against at least said inner and outer die surfaces.

37. An apparatus, as claimed in claim 36, wherein said nose portion has a radius of between about 0.003 inches and about 0.007 inches.

38. An apparatus, as claimed in claim 36, wherein said punch further comprises inner and outer inclined surfaces adjacent said nose portion for supporting said at least a portion of said annular groove in substantial conforming relation therewith upon collapse of said at least a portion of said annular groove.

39. An apparatus, as claimed in claim 38, wherein said inner and outer inclined surfaces of said punch are generally angularly oriented to correspond with said inner and outer die surfaces, respectively.

40. An apparatus, as claimed in claim 38, wherein said inner and outer inclined surfaces of said punch are each inclined at an angle of between about 30° and 60° relative to an axis of said punch.

41. An apparatus, as claimed in claim 36, wherein said punch further comprises an inner curved part displaced above said nose portion for engaging said annular groove to exert an outwardly directed force, away from said punch, on said annular groove.

42. An apparatus, as claimed in claim 41, wherein said inner curved part has a radius of 0.028 inches and 0.032 inches, respectively.

43. An apparatus, as claimed in claim 26, wherein said inner and outer die surfaces collectively define a substantially v-shaped concave surface.

44. A method for forming an end piece out of a portion of sheet metal comprising first and second surfaces, said end piece being attachable to an open end of a container body, said method comprising the steps of:

feeding the portion of sheet metal to a first station;

blanking the portion of sheet metal at said first station to obtain a blank; and forming said blank at said first station to produce said end piece, said end piece comprising a central panel, an annular groove disposed about a perimeter of said central panel and having a first curved portion disposed on a bottom of said annular groove and which is substantially defined by a radius of less than about 0.010 inches, and a flange disposed about said annular groove, wherein a portion of said first surface defined by a bottom portion of said annular groove is concave and a portion of said second surface defined by said bottom portion of said annular groove is convex, wherein said forming step comprises initiating a definition of said annular groove and completing said definition of said annular groove by moving said flange relative to said center panel and maintaining said portion of said first surface which will define said first curved portion of said annular groove substantially free from contact with any portion of said first station throughout said initiating a definition and completing said definition steps.

45. A method, as claimed in claim 44, wherein said forming step comprises exerting an annular axial force on an outer portion of said blank to form said flange.

46. A method, as claimed in claim 44, wherein said blank comprises an intermediate portion extending between an outer portion and a central portion, wherein said forming step comprises exerting an annular axial force on said outer portion and relative to said central portion of said blank to form said annular groove in said intermediate portion.

47. A method, as claimed in claim 44, wherein said blank comprises an intermediate portion extending between an outer portion and a central portion, wherein said forming step comprises applying an annular outwardly-directed force on at least part of said intermediate portion and relative to said intermediate portion to form said first curved portion of said annular groove having said radius of less than about 0.010 inches.

48. A method, as claimed in claim 44, wherein said blank comprises an intermediate portion extending between an outer portion and a central portion of said blank, wherein said first station comprises first and second inner dies and first and second outer dies which are used for said forming step.

49. A method, as claimed in claim 48, wherein said forming step comprises slidably engaging said outer portion of said blank between said first and second outer dies and engaging a central portion of said blank between said first and second inner dies.

50. A method, as claimed in claim 49, wherein said forming step further comprises moving said first outer die relative to said first and second inner dies and said central portion of said blank to form said flange.

51. A method, as claimed in claim 49, wherein said forming step further comprises moving said second outer die relative to said first and second inner dies and said central portion of said blank to flex said intermediate portion to form said annular groove.

52. A method, as claimed in claim 49, wherein said first inner die comprises a first die surface for engaging at least part of said intermediate portion of said blank, wherein said forming step further comprises exerting an outwardly-directed force on at least a part of said intermediate portion by engaging said first die surface of said first inner die against said part of said intermediate portion to deform said part of said intermediate portion to form said annular groove.

53. A method, as claimed in claim 52, wherein said first die surface of said first inner die is inclined between about 30° and about 60° relative to a vertical reference axis.

54. A method, as claimed in claim 44, wherein said forming step comprises first forming said flange and then forming said annular groove, and wherein said forming said annular groove step comprises exerting a first force on said flange, opposing said first force on at least a first portion of said central panel, and flexing an annular portion of said blank against a generally concave surface in a general direction of said first force using said exerting step.

55. A method for reforming an end piece which is attachable to an open end of a container body, said end piece comprising a central panel having a first panel diameter, an annular groove disposed about a perimeter of said central panel and having a lower portion substantially defined by a first radius, and a flange disposed about said annular groove, wherein said annular groove further comprises a first curved portion extending between and integrally joining a chuckwall and an inner panel wall of said annular groove, said first curved portion being located at the bottom of said annular groove, said method comprising the step of:

reworking said annular groove to reduce a magnitude of said first radius to a second radius, comprising the steps of exerting an inwardly-directed force on at least part of said annular groove and relative to said annular groove and collapsing said at least part of said annular groove inwardly relative to said annular groove, wherein at least one reworking tool comprising a punch and inner and outer die surfaces is used for said exerting step, wherein said exerting step comprises engaging portions of said chuckwall, said first curved portion and said inner panel wall between said punch and said inner and outer die surfaces, wherein said exerting step further comprises moving said punch relative to said annular groove and said inner and outer die surfaces to push unsupported concave portions of said first curved portion inwardly, toward said punch, and wherein said inner and outer die surfaces engage parts of said unsupported concave portions at an angle generally normal thereto.

56. A method for reforming an end piece which is attachable to an open end of a container body, said end piece comprising a central panel having a first panel diameter, an annular groove disposed about a perimeter of said central panel and having a lower portion substantially defined by a first radius, and a flange disposed about said annular groove, wherein said annular groove further comprises a first curved portion extending between and integrally joining a chuckwall and an inner panel wall of said annular groove, said first curved portion being located at the bottom of said annular groove, said method comprising the step of:

reworking said annular groove to reduce a magnitude of said first radius to a second radius, comprising the steps of exerting an inwardly-directed force on at least part of said annular groove and relative to said annular groove and collapsing said at least part of said annular groove inwardly relative to said annular groove, wherein at least one reworking tool comprising a punch and inner and outer die surfaces is used for said exerting step, wherein said exerting step comprises engaging portions of said chuckwall, said first curved portion and said inner panel wall between said punch and said inner and outer die surfaces, wherein said exerting step further comprises moving said punch relative to said annular groove and said inner and outer die surfaces to push unsupported concave portions of said first curved portion inwardly, toward said punch, and wherein said exerting step further comprises exerting an inwardly-directed force toward said punch on an upper part of said annular groove by engaging an upper portion on said annular groove, and exerting an outwardly-directed force away from said punch on a lower part of said annular groove by engaging an intermediate portion of said annular groove, wherein said upper and intermediate portions are located on said inner panel wall.

57. A method, as claimed in claim 56, wherein said reworking tool further comprises a vertical working surface adjacent said inner die surface, wherein said exerting an inwardly-directed force toward said punch step comprises engaging said vertical working surface against said upper portion of said inner panel wall.

58. A method, as claimed in claim 56, wherein said punch comprises a nose portion for engaging said first curved portion and an inner curved part displaced above said nose portion, wherein said exerting an outwardly-directed force away from said punch step comprises engaging said inner curved part of said punch against said intermediate portion of said inner panel wall.

59. A method for reforming an end piece which is attachable to an open end of a container body, said end piece comprising a central panel having a first panel diameter, an annular groove disposed about a perimeter of said central panel and having a lower portion substantially defined by a first radius, and a flange disposed about said annular groove, wherein said annular groove further comprises a first curved portion extending between and integrally joining a chuckwall and an inner panel wall of said annular groove, said first curved portion being located at the bottom of said annular groove, said method comprising the step of:

reworking said annular groove to reduce a magnitude of said first radius to a second radius, comprising the steps of exerting an inwardly-directed force on at least part of said annular groove and relative to said annular groove and collapsing said at least part of said annular groove inwardly relative to said annular groove, wherein at least one reworking tool comprising a punch and inner and outer die surfaces is used for said exerting step; and exerting an inwardly-directed force toward said punch on one of said chuckwall and said inner panel wall to form a second curved portion, separate from said first curved portion, on said annular groove.

60. A method, as claimed in claim 59, wherein said second curved portion is formed on said chuckwall and has a radius of between about 0.025 inches and about 0.035 inches.

61. A method, as claimed in claim 59, wherein said second curved portion is formed on said inner panel wall and has a radius of between about 0.025 inches and about 0.035 inches.

* * * * *